US011090650B2

(12) United States Patent
Dreibholz et al.

(10) Patent No.: US 11,090,650 B2
(45) Date of Patent: Aug. 17, 2021

(54) METHOD FOR MANUFACTURING A TEST ELEMENT FOR DETECTING AN ANALYTE IN A BODY FLUID

(71) Applicant: Roche Diabetes Care, Inc., Indianapolis, IN (US)

(72) Inventors: Joerg Dreibholz, Dienheim (DE); Volker Hullen, Mannheim (DE); Maria Dambach, Mannheim (DE); Herbert Fink, Mannheim (DE); Daniela Pfiffi, Mannheim (DE); Bernd Hiller, Lampertheim (DE); Carina Horn, Biblis (DE)

(73) Assignee: ROCHE DIABETES CARE, INC., Indianapolis, IN (US)

( * ) Notice: Subject to any disclaimer, the term of this patent is extended or adjusted under 35 U.S.C. 154(b) by 197 days.

(21) Appl. No.: 15/975,362

(22) Filed: May 9, 2018

(65) Prior Publication Data

US 2018/0345283 A1 Dec. 6, 2018

(30) Foreign Application Priority Data

May 31, 2017 (EP) ..... 17173730

(51) Int. Cl.
*B01L 3/00* (2006.01)

(52) U.S. Cl.
CPC ... *B01L 3/502707* (2013.01); *B01L 3/502715* (2013.01); *B01L 2200/12* (2013.01);
(Continued)

(58) Field of Classification Search
CPC ..... B01L 3/502707; B01L 3/502715; B01L 2300/0887; B01L 2400/088;
(Continued)

(56) References Cited

U.S. PATENT DOCUMENTS 5,759,364 A 6/1998 Charlton et al.
6,696,024 B1 2/2004 Leichner et al.
(Continued)

FOREIGN PATENT DOCUMENTS

DE 2006/017358 A1 2/2006
EP 1 035 919 B1 9/2000
(Continued)

OTHER PUBLICATIONS

Hoenes, Joachim et al.: The Technology Behind Glucose Meters: Test Strips, Diabetes Technology & Therapeutics, vol. 10, Supplement 1, 2008, S-10 to S-26. 17 pages.

*Primary Examiner* — Jennifer Wecker
*Assistant Examiner* — Michael Paul Shimek
(74) *Attorney, Agent, or Firm* — Woodard, Emhardt, Henry, Reeves & Wagner, LLP

(57) ABSTRACT

A method for manufacturing a test element for detecting at least one analyte in a body fluid, a test element for detecting at least one analyte in a body fluid, a method for detecting at least one analyte in a body fluid, a system for detecting at least one analyte in a body fluid and a method for manufacturing a test element for detecting at least one analyte in a body fluid are disclosed. The method for manufacturing a test element for detecting at least one analyte in a body fluid comprises the following steps:

a) providing at least one substrate having at least one elongate receptacle on a substrate surface of the substrate;
b) placing at least one test chemical on the substrate in a manner that the test chemical covers a partition of the elongate receptacle;
c) placing at least one cover element on the substrate such that the cover element covers the elongate receptacle at least partially, whereby a channel having a channel surface is formed;

(Continued)

wherein at least one hydrophilic material is applied in a manner that at least one surface section of the channel surface is covered with the hydrophilic material, wherein the surface section is adjacent to the test chemical.

18 Claims, 7 Drawing Sheets

(52) U.S. Cl.
CPC . *B01L 2300/047* (2013.01); *B01L 2300/0663* (2013.01); *B01L 2300/0825* (2013.01); *B01L 2300/0887* (2013.01); *B01L 2300/12* (2013.01); *B01L 2300/161* (2013.01); *B01L 2400/0406* (2013.01); *B01L 2400/088* (2013.01)

(58) Field of Classification Search
CPC ..... B01L 2300/0663; B01L 2300/161; B01L 2300/12; B01L 2300/0825; B01L 2400/0406; B01L 2300/047; B01L 2200/12
See application file for complete search history.

(56) References Cited

U.S. PATENT DOCUMENTS

| | | | | |
|---|---|---|---|---|
| 2011/0053289 | A1 | 3/2011 | Lowe et al. | |
| 2012/0230674 | A1 | 9/2012 | Kuriger | |
| 2014/0349279 | A1* | 11/2014 | Berthelot ..... | B23P 19/00 435/5 |
| 2016/0082434 | A1* | 3/2016 | Hiller ..... | C12Q 1/54 422/412 |
| 2016/0266098 | A1 | 9/2016 | Horn et al. | |

FOREIGN PATENT DOCUMENTS

| | | |
|---|---|---|
| EP | 2 144 061 A1 | 1/2010 |
| EP | 2012/116780 | 9/2012 |
| JP | 3 998807 B2 | 4/1998 |

* cited by examiner

METHOD FOR MANUFACTURING A TEST ELEMENT FOR DETECTING AN ANALYTE IN A BODY FLUID

FIELD OF THE INVENTION

The methods and devices according to the present invention may be used for detecting at least one analyte present in one or both of a body tissue or a body fluid, in particular the method and devices may be applied in the field of detecting one or more analytes such as glucose, lactate, triglycerides, cholesterol or other analytes, preferably metabolites, in body fluids such as blood, preferably whole blood, plasma, serum, urine, saliva, interstitial fluid or other body fluids, both in the field of professional diagnostics and in the field of home monitoring. However, other fields of application are feasible.

RELATED ART

In the field of medical technology and diagnostics, a large number of devices and methods for detecting at least one analyte in a body fluid are known. The method and devices may be used for detecting at least one analyte present in one or both of a body tissue or a body fluid, in particular one or more analytes such as glucose, lactate, triglycerides, cholesterol or other analytes, preferably metabolites, in body fluids such as blood, preferably whole blood, plasma, serum, urine, saliva, interstitial fluid or other body fluids. Further devices are known for measuring activating times, e.g. a thrombin activation time measurement for coagulation monitoring. Without restricting the scope of the present invention, in the following, mainly reference is made to the determination of glucose as an exemplary and preferred analyte.

The determination of blood glucose concentration as well as a corresponding medication is an essential part of daily routine for many diabetics. In order to increase convenience and in order to avoid restricting the daily routine by more than a tolerable degree, portable devices and test elements are known in the art, such as for measuring blood glucose concentration during work, leisure or other activities away from home. In the meantime, many test devices are commercially available. A large number of test devices and test systems are known which are based on the use of test elements in the form of test strips. Applications are known, in which a multiplicity of test strips is provided by a magazine, wherein a test strip from the magazine automatically may be provided to the testing device. Other applications, however, are known in which single test strips are used, which are inserted into the testing device manually by a user. Therein, typically, the end of the test strip is adapted to be inserted into the testing device and for detecting the analyte, wherein the opposing end of the test strip serves as a handle enabling the user to push the test strip into the testing device or to remove the test strip from the testing device. For applying the sample to the test element, typical test elements provide at least one sample application site, such as a capillary opening in capillary test elements or a sprite net in optical test strips having a top dosing system. Test strips of this type are commercially available, e.g. under the trade name Accu-Chek Active®. Alternatively to home care applications, such test elements may be used in professional diagnostics, such as in hospital applications.

In many cases, for detecting the analyte, test elements are used, such as test strips, which comprise one or more test fields having one or more test chemistries. The test chemistries are adapted to change one or more detectable properties in the presence of the analyte to be detected. Thus, electrochemically detectable properties of the test chemistry and/or optically detectable properties of the test chemistry may be changed due to the influence of the presence of the analyte. For potential test chemistries which may be used within the present invention, reference may be made to J. Hones et al.: Diabetes Technology and Therapeutics, Vol. 10, Supplement 1, 2008, S-10 to S-26. However, other types of test chemistries may be used within the present invention.

Exemplarily, the detection of the at least one analyte can be performed by using an electrochemical test element. Commonly used are disposable electrochemical capillary sensor test elements. Such test elements typically comprise at least one working electrode for detecting the analyte as well as at least one counter electrode to support a current flow through a measuring cell of the test element. In addition, optionally, the test element may comprise at least one reference electrode. In alternative embodiments, a reference electrode may be designed individually and/or may be combined with the counter electrode. However, other types of measurement setups are possible, in order to derive an analyte concentration from a comparison of electrode potentials.

Commonly, the test elements may be comprise several layers, the layers being manufactured by a combination of conventional methods such as dip coating or laminating individual foils.

In WO 2006/017358 A1 systems and methods for measuring an analyte in a host are described. More particularly, the present invention relates to systems and methods for transcutaneous measurement of glucose in a host. The transcutaneous analyte sensor system can include an applicator, a mounting unit, an electronics unit, a base adapted for mounting on a skin of a host, and one or more contacts configured to provide electrical contact between the sensor and the electronics unit.

In EP 2681329 A1 a method for producing a test element for studying a body fluid sample is described. The detection layer is covered with a polymeric spread layer and applied to a support. According to the invention it is provided that the spread layer is produced by being sprayed onto the detection layer. The invention further elates to such a test element having a spread layer that has a thickness of at most 20 μm.

In EP 1 035 919 B1 a device for the capillary transport of a liquid between two opposite lying, essentially planar layers is described. Both layers are arranged at a distance from and parallel to one another in such a way that a capillary active gap is created between both layers. The invention is characterized in such a way that at least one of the layers comprises at least two discrete adjacent parts, and that the capillary active transport of the liquid can flow beyond the common boundary of the parts which are situated in a layer.

In EP 2 144 061 A1 an electrochemical sensor for determining a coagulation parameter is described. The coagulation parameter comprises a carrier; at least two electrodes, which are applied on the carrier; at least one test reagent; and a surfactant-containing coating. Independent claims are included for: (1) coating a sensor film with a surfactant-solvent mixture, comprising applying the surfactant-solvent mixture by piezo-printing; (2) preparing the electrochemical sensor, comprising providing a carrier, applying at least two electrodes on the carrier, applying at least one test reagent, applying a surfactant-solvent mixture and affixing a lid, thus a capillary sensor element is formed;

and (3) electrochemical test element analysis system, comprising the electrochemical sensor and at least a current- or voltage meter.

Despite of the advantages and the progress achieved by the above-mentioned developments, some significant technical challenges remain. Conventional production methods, specifically conventional production methods such as dip coating or laminating individual foils generally imply a number of limitations when it comes to producing defined three-dimensional multi-layered structures, producing thin layers, specifically thin layers with a thickness of smaller than 10 μm, producing test elements with several adjacent, functionalized areas, wherein the areas are specifically smaller than 1 $mm^2$, producing sequences of layers having components which are not stable in a dissolved status or in a moist status as they would react with each other, manufacturing layers which are stable at temperatures which exceed room temperatures or producing layers having a three-dimensional structures, e.g. comprising pores and cavities.

Problem to be Solved

It is therefore an objective of the present invention to provide a method for manufacturing a test element for detecting at least one analyte in a body fluid, a test element for detecting at least one analyte in a body fluid, a method for detecting at least one analyte in a body fluid, a system for detecting at least one analyte in a body fluid and a method for manufacturing a test element for detecting at least one analyte in a body fluid which at least partially avoid the shortcomings of known devices and methods of this kind and which at least partially address the above-mentioned challenges. Specifically, methods shall be disclosed which allow for easy manufacturing of test elements.

SUMMARY OF THE INVENTION

This problem is solved by a method and a device for a method for manufacturing a test element for detecting at least one analyte in a body fluid, a test element for detecting at least one analyte in a body fluid, a method for detecting at least one analyte in a body fluid, a system for detecting at least one analyte in a body fluid and a method for manufacturing a test element for detecting at least one analyte in a body fluid with the features of the independent claims. Preferred embodiments, which might be realized in an isolated fashion or in any arbitrary combination, are listed in the dependent claims.

As used in the following, the terms "have", "comprise" or "include" or any arbitrary grammatical variations thereof are used in a non-exclusive way. Thus, these terms may both refer to a situation in which, besides the feature introduced by these terms, no further features are present in the entity described in this context and to a situation in which one or more further features are present. As an example, the expressions "A has B", "A comprises B" and "A includes B" may both refer to a situation in which, besides B, no other element is present in A (i.e. a situation in which A solely and exclusively consists of B) and to a situation in which, besides B, one or more further elements are present in entity A, such as element C, elements C and D or even further elements.

Further, it shall be noted that the terms "at least one", "one or more" or similar expressions indicating that a feature or element may be present once or more than once typically will be used only once when introducing the respective feature or element. In the following, in most cases, when referring to the respective feature or element, the expressions "at least one" or "one or more" will not be repeated, non-withstanding the fact that the respective feature or element may be present once or more than once.

Further, as used in the following, the terms "preferably", "more preferably", "particularly", "more particularly", "specifically", "more specifically" or similar terms are used in conjunction with optional features, without restricting alternative possibilities. Thus, features introduced by these terms are optional features and are not intended to restrict the scope of the claims in any way. The invention may, as the skilled person will recognize, be performed by using alternative features. Similarly, features introduced by "in an embodiment of the invention" or similar expressions are intended to be optional features, without any restriction regarding alternative embodiments of the invention, without any restrictions regarding the scope of the invention and without any restriction regarding the possibility of combining the features introduced in such way with other optional or non-optional features of the invention.

In a first aspect of the present invention, a method for manufacturing a test element for detecting at least one analyte in a body fluid is disclosed. The method comprises the method steps as given in the independent claims and as listed as follows. The method steps may be performed in the given order. However, other orders of the method steps are feasible. Further, one or more of the method steps may be performed in parallel and/or on a timely overlapping fashion. Further, one or more of the method steps may be performed repeatedly. Further, additional method steps may be present which are not listed.

The method for manufacturing a test element for detecting at least one analyte in a body fluid comprises the following steps:

a) providing at least one substrate having at least one elongate receptacle on a substrate surface of the substrate;
b) placing at least one test chemical on the substrate in a manner that the test chemical covers a partition of the elongate receptacle;
c) placing at least one cover element on the substrate such that the cover element covers the elongate receptacle at least partially, whereby a channel having a channel surface is formed;

wherein at least one hydrophilic material is applied, particularly via one of spray coating or blanket coating, in a manner that at least one surface section of the channel surface is covered with the hydrophilic material, wherein the surface section is adjacent to the test chemical.

As further used herein, the term "manufacturing" may refer to an arbitrary process of producing or assembling an arbitrary device, specifically in a mechanical way. Specifically, the term manufacturing may refer to a value added production of a device for use. For the process of manufacturing machines, tools, chemical and biological processing or formulation may be applied. The manufacturing process may comprise a number of different manufacturing steps which may be performed in a given order. However, one or more of the manufacturing steps may be performed in parallel and/or on a timely overlapping fashion. Further, one or more of the manufacturing steps may be performed repeatedly. Exemplarily, the manufacturing process may begin with a creation of materials from which a device is made. These materials may then be modified through the manufacturing process to become the desired device. Further, exemplarily, the device may be assembled by combining several separate components. However, other embodiments may be feasible.

As further used herein, the term "test element" may refer an arbitrary device which is capable of detecting the analyte in a sample or of determining at least one parameter of the sample. The test element may therefore have at least one receptacle which is configured to receive the sample. Further, the test element may have at least one test field wherein the detection of the analyte in the sample or the determination of the at least one parameter occurs. Exemplarily, the test field may comprise at least one test chemistry which will further be described below in more detail. The test element may be an arbitrary monolithic device or an arbitrary one-piece device. Specifically, the test element may be a strip-shaped test element. As used herein, the term "strip-shaped" refers to an element having an elongated shape and a thickness, wherein an extension of the element in a lateral dimension exceeds the thickness of the element, such as by at least a factor of 2, preferably by at least a factor of 5, more preferably by at least a factor of 10 and most preferably by at least a factor of 20 or even at least a factor of 30. Thus, the test element may also be referred to as test strip.

The term "analyte" may generally refer to an arbitrary element, component or compound which may be present in the sample and the presence and/or the concentration of which may be of interest for the user, the patient or medical staff such as a medical doctor. Particularly, the analyte may be or may comprise an arbitrary chemical substance or chemical compound which may take part in the metabolism of the user or the patient, such as at least one metabolite. The detection of the at least one analyte specifically may be an analyte-specific detection.

As further used herein, the term "body fluid" may refer to a fluid which typically is present in a body or body tissue of the user or the patient and/or which may be produced by the body of the user or the patient. As an example for body tissue, interstitial tissue may be named. Thus, as an example, the body fluid may be selected from the group consisting of blood and interstitial fluid. However, additionally or alternatively, one or more other types of body fluids may be used, such as saliva, tear fluid, urine or other body fluids. During detection of the at least one analyte, the body fluid may be present within the body or body tissue. Thus, specifically, as will be outlined in further detail below, the sensor may be configured for detecting at least one analyte in a body tissue.

The term "detecting" may generally refer to a process of determining a presence and/or a quantity and/or a concentration of the at least one analyte. Thus, the detection may be or may comprise a qualitative detection, simply determining a presence of the at least one analyte or a absence of the at least one analyte, and/or may be or may comprise a quantitative detection, which determines the quantity and/or the concentration of the at least one analyte. As a result of the detection, at least one signal may be produced which characterizes an outcome of the detection, such as at least one measurement signal. The at least one signal specifically may be or may comprise at least one electronic signal such as at least one voltage and/or at least one current. The at least one signal may be or may comprise at least one analogue signal and/or may be or may comprise at least one digital signal. Therefore, the detection may be conducted via at least one sensor. The term "sensor" may generally refer to an arbitrary element which is adapted to perform a process of detection and/or which is adapted to be used in the process of detection. Thus, the sensor specifically may be adapted to determine the concentration of the analyte and/or a presence of the analyte. The sensor may be part of a measurement device or analytical device as will further be described below in more detail.

As described above, the at least one substrate is provided. The term "substrate" may refer to an arbitrary element which is suitable to carry one or more other elements disposed thereon or therein. As an example, the substrate may be a flat substrate, such as a substrate having a lateral extension exceeding its thickness by at least a factor of 2, at least a factor of 5, at least a factor of 10, or even at least a factor of 20 or more. The substrate specifically may have an elongated shape, such as a strip-shape and/or a bar-shape.

The substrate may be at least partially manufactured of at least one hydrophobic material. As further used herein, the term "hydrophobic" may refer to a physical property of a molecule, specifically of a molecule of an arbitrary solid element or of an arbitrary fluidic medium, of being repelled form a mass of water. Generally, hydrophobic molecules tend to be nonpolar and, thus, prefer other neutral molecules and nonpolar solvents. Because water molecules are polar, the hydrophobic molecules do not dissolve well among them. The hydrophobic molecules in water often cluster together, forming micelles. Water on hydrophobic surfaces may exhibit a high contact angle. In contrast, hydrophilic molecules are generally attracted to water as will further be described below in more detail. Specifically, the substrate may be manufactured of at least one polymer, specifically of at least one thermoplastic polymer. Preferably, the substrate may be manufactured of at least one of polyethylene terephthalate; polycarbonate; polystyrene; polyvinyl chloride; polypropylene; poly(methyl methacrylate); polyurethane; polyester; acrylonitrile butadiene styrene; polymer blends. However, other materials may also be feasible.

As described above, the substrate has at least one elongate receptacle on the substrate surface. As further used herein, the term "receptacle" may refer to an arbitrary element of an object which is configured to receive or to hold something. Therefore, the receptacle may have or may be embodied as a recess or as a cavity of the object. Further, the term "elongate receptacle" may refer an arbitrary receptacle wherein an extension of the receptacle in a lateral dimension exceeds a width of the elongate receptacle, such as by at least a factor of 2, preferably by at least a factor of 5, more preferably by at least a factor of 10 and most preferably by at least a factor of 20 or even at least a factor of 30. The elongate receptacle may specifically have a length of 3 mm to 50 mm, preferably of 5 mm to 30 mm, more preferably of 10 mm to 20 mm, most preferably of 12 mm. Further, the elongate receptacle may have a width of 0.1 mm to 10 mm, preferably a width of 0.5 mm to 5 mm, more preferably a width of 1 mm to 2 mm. Moreover, the elongate receptacle may have a thickness of 20 μm to 100 μm, preferably of 30 μm to 90 μm, more preferably of 50 μm to 80 μm, most preferably of 70 μm.

The elongate receptacle may be formed on the substrate surface. The term "forming" may refer to an arbitrary process of making or constructing something. Thereby, exemplarily, several components may be assembled in such a way that a desired feature may emerge. However, other embodiments may be feasible. Specifically, the elongate receptacle may be formed by placing at least one foil, specifically at least one adhesive foil, on the substrate. The adhesive foil may exemplarily be a double-sided adhesive foil. Exemplarily, the foil may comprise at least one opening extending in a direction of extension of the foil and the elongate receptacle may be formed by the opening. The foil may have a thickness of 20 μm to 100 μm, preferably of 30

μm to 90 μm, more preferably of 50 μm to 80 μm, most preferably of 70 μm. However, other embodiments may be feasible. Exemplarily, the elongate receptacle may be formed by generating a groove directly into the substrate. Further, additionally or alternatively, the substrate may be manufactured with the elongate receptacle such as via injection molding. However, also other embodiments may be feasible.

In a further step, as described above, the at least one test chemical is placed on the substrate. As further used herein, the term "test chemical" also referred to as test chemistry, may refer to an arbitrary material or a composition of materials adapted to change at least one detectable property in the presence of the analyte. Generally, this property may be selected from an electrochemically detectable property and/or an optically detectable property, such as a color change and/or a change in remissive properties. Specifically, the test chemical may be a highly selective test chemical, which only changes the property if the analyte is present in the sample of the body fluid applied to the test element, whereas no change occurs if the analyte is not present. More preferably, the degree or change of the property may be dependent on the concentration of the analyte in the body fluid, in order to allow for a quantitative detection of the analyte.

As an example, the test chemical may comprise at least one enzyme, such as glucose oxidase and/or glucose dehydrogenase. Additionally or alternatively, the test chemical may comprise one or more co-enzymes and/or one or more mediators. Further, alternatively or additionally, the test chemical may comprise one or more dyes, which, preferably in interaction with the one or more enzymes, may change their color in the presence of the at least one analyte to be detected.

The test chemical may be configured for performing at least one of an electrochemical detection reaction and an optically detectable detection reaction. The electrochemical detection reaction and the optically detectable detection reaction may be analyte specific. Further, the electrochemical detection reaction and the optically detectable detection reaction may be a qualitative and/or a quantitative detection. As used herein, the term "optically detectable detection reaction" refers to a detection of an optical detectable property of the analyte itself or an auxiliary compound which is produced or converted with a detection reaction depending on the presence and/or concentration of the analyte in the sample, such as a color change and/or a change in remissive properties.

Exemplarily, the test chemical may form a layer on the substrate. Specifically, the test chemical may be provided on the substrate via spray coating. However, other methods for generating a layer on a substrate may be feasible. Further, additionally or alternatively, the test chemical may be provided as a test chemical element. The test chemical element may exemplarily be manufactured by depositing the test chemical on at least one test chemical substrate. Thereby, the test chemical substrate and the test chemical may form the test chemical element and the test chemical element may be placed onto the substrate. However, other embodiments may be feasible.

As described above, the test chemical is placed in a manner that the test chemical covers the partition, e.g. a part, of the elongate receptacle. Thereby, the term "covering" may refer to a process wherein the test chemical, specifically when provided as test chemical element, is placed over the elongate receptacle. Thus, the test chemical may rest on the substrate such as on the adhesive foil. Specifically, the test chemical may be fixedly attached to the adhesive foil. Additionally or alternatively, the test chemical may be received within the elongate receptacle such as being in direct contact with a surface of the elongate receptacle. This may specifically be the case when the test chemical is provided as a layer via spray coating as described above or as a flexible foil. However, other embodiments may be feasible.

In a further step, as described above, the at least one cover element is placed on the substrate. As further used herein, the term "cover element" may refer to an arbitrary element which is suitable to be or to serve as a covering for another object or the like, especially for covering at least a partition of the elongate receptacle. Specifically, the cover element may be configured to serve as a protection, in particular, from environmental influences and/or to seal the other object or the like from environmental influences. As an example, the cover element may have at least one flat surface. The flat surface may be configured to serve as a contact area or support areas. The cover element may further have a lateral extension exceeding its thickness by at least a factor of 2, at least a factor of 5, at least a factor of 10, or even at least a factor of 20 or more. The cover element may have a shape which corresponds to a shape of the substrate as described above. The cover element specifically may have an elongated shape, such as a strip-shape and/or a bar-shape. Further, specifically, the cover element may have a width with is equivalent to the width of the substrate. Further, the cover element may have a length which is smaller than a length of the elongate receptacle, such as by at least a factor of 0.9, preferably by at least a factor of 0.8, more preferably by at least a factor of 0.7 and most preferable by at least a factor of 0.5. However, other embodiments may be feasible. Further, the cover element may have a thickness of 10 μm to 200 μm, preferably of 30 μm to 150 μm, more preferably of 50 μm to 100 μm. Further, the cover element may have a width of 1 mm to 20 mm, preferably of 3 mm to 12 mm, more preferably of 4 mm to 6 mm and most preferably of 5 mm. As an example, the cover element may be a cover foil. Specifically, the cover foil may be at least partially manufactured of polyethylene terephthalate; polycarbonate; polystyrene; polyvinyl chloride; polypropylene; poly(methyl methacrylate); polyurethane; polyester.

Further, as described above, the cover element covers the elongate receptacle at least partially, preferably partially, by which a channel is formed. As further used herein, the term "channel" may refer to arbitrary element of an object which is configured to enable a transport of an arbitrary medium such as a fluidic medium within the element, such as from one end of the element to another end of the element. The channel may have an interior volume which may be fully or at least partially enclosed or surrounded by a wall of the object. Therefore, a flow of a fluid medium or an insertion of another object from one end of the element to a further end through the interior volume may be feasible. As further used herein, the term "wall" may refer to an arbitrary structure, specifically a structural material, which is configured to at least partially surround another object or volume thereby defining physical limits of an object. Further, the wall may be configured to protect the interior volume or the other object at least partially enclosed by the wall. The channel may specifically have an elongate shape, e.g. an extension of the channel in a lateral dimension may exceeds a width of the channel, such as by at least a factor of 2, preferably by at least a factor of 5, more preferably by at least a factor of 10 and most preferably by at least a factor of 20 or even at least a factor of 30.

Specifically, the channel may be a capillary channel, also referred to as capillary. As used herein, the term "capillary channel" may refer to an element which is adapted to receive a sample of a fluidic medium and/or to transport the sample of the fluidic medium by capillary forces. The capillary channel may comprise at least one volume configured to receive the fluidic medium, e.g. via one or more capillary caps and/or via one or more capillary slots and/or one or more capillary tubes having an arbitrary cross-section, such as a rectangular cross-section Specifically, the capillary channel may be configured to receive the sample of the body fluid and/or transport the sample of the body fluid by the capillary forces and/or a round cross-section and/or a polygonal cross-section.

Further, the channel has a channel surface, e.g. a surface of the channel. Specifically, the at least one channel surface of the channel may be formed by at least one surface selected from the group consisting of: a substrate surface of the substrate; a cover element surface of the cover element; a receptacle surface of the elongate receptacle. The receptacle surface and the substrate surface may be at least partially identical to each other. Exemplarily, the elongate receptacle may be formed by the substrate and the adhesive foil having the opening as described above. Thus, the at least one surface of the channel may be formed by the substrate surface, the cover element surface and a foil surface of the adhesive foil. Further, exemplarily, the elongate receptacle may be formed as a groove within the substrate as described above. Thereby, the substrate surface may be at least partially identical to the receptacle surface. Further, the method for manufacturing a test element may comprise further steps of coating at least one of the cover element surface, the receptacle surface, the substrate surface such with further layers are generated or of placing further elements such as foils, membranes or the like on the at least one of the cover element surface, the receptacle surface, the substrate surface. Thereby, the at least one surface of the channel may also be formed by at least one surface of the further layers or of the further elements such as of the foils.

In an embodiment of the present invention, the channel may be formed by cutting the cover foil and the adhesive foil to a similar length, thus allowing the channel to be filled with a sample of the body fluid applied by side filling. In an alternative embodiment of the present invention, the channel may be formed by cutting the cover foil shorter than the adhesive foil, thus allowing the channel to be filled with a sample of the body fluid applied by top filling. However, further embodiments may also be feasible.

As described above, the at least one hydrophilic material is applied via spray coating in a manner that at least one surface section between the test chemical and the channel surface is covered with the hydrophilic material. As further used herein, the term "hydrophilic" may refer to a property of an arbitrary molecule or of an arbitrary molecular entity or of an arbitrary material of being attracted to water molecules and of being at least to a large extend dissolvable by water. Generally, a hydrophilic molecule or a portion of the hydrophilic molecule may be able to interact with water and other polar substances in a more thermodynamically favorable way than to interact with oil or other hydrophobic solvents. The hydrophobic molecules may typically be charge-polarized and capable of hydrogen bonding. The hydrophilic molecules can be contrasted with hydrophobic molecules. In some cases, both hydrophilic and hydrophobic properties occur in a single molecule.

The hydrophilic material may be provided as a suspension or as a solution. The term "suspension" may refer to a heterogeneous mixture comprising at least one medium, specifically at least one fluidic medium, as well as particles, specifically solid particles, that are sufficiently large for sedimentation. The particles may specifically be larger than one micrometer. Thus, the particles do not dissolve but get suspended throughout a bulk of the fluid medium. Generally, the particles may be visible by eye. Suspensions can generally be classified on basis of a dispersed phase and a dispersion medium, wherein the dispersed phase is essentially solid, e.g. fully or partially solid, while the dispersion medium may either be a solid, a liquid, or a gas. Suspensions may be unstable from a thermodynamic point of view; however, suspensions can be kinetically stable over a large period of time, which determines a shelf life. Further, the term "solution" may generally refer to a homogeneous mixture comprising two or more substances. The solution may specifically comprise at least one solvent and at least one solute. Thereby, the term "solute" may refer to an arbitrary substance which is dissolved in another substance. The solution may at least to a large extend have properties, specifically physical properties, which correspond to properties of the solvent including a phase. Commonly, the solvent may be a major fraction of the mixture. The concentration of a solute in a solution is a measure of how much of that solute is dissolved in the solvent, with regard to how much solvent is present like salt.

Specifically, the suspension or the solution may comprise at least one solvent. The term "solvent" may refer to an arbitrary substance that dissolves a solute, e.g. a chemically distinct liquid, solid or gas, resulting in a solution. A solvent may usually be a liquid but can also be a solid or a gas. A quantity of solute that can usually dissolve in a specific volume of solvent varies with temperature. Exemplarily, the solvent may evaporates while the spray coating is conducted. However, additionally or alternatively, the solvent may be removed after conducting the spray coating via at least one drying process.

The hydrophilic material may comprise at least one material selected from the group consisting of: a polymer; a surface-active substance, a filling material, a dye, and a reactive component. Specifically, the polymer may be selected from the group consisting of: cellulose, polyethylene glycol, polyvinyl alcohol, polyolefin, polyurethane, polyamide, polyimide, polyacrylate, polycarbonate, polyester, polyether, polyvinyl ether, polyvinyl ester, polyvinyl alcohol, and polysiloxane.

Further, the surface-active substance may be a surfactant, specifically a hydrophilic surfactant, specifically an anionic surfactant. As further used herein, the term "surfactant" may refer to an arbitrary molecule is configured to lower a surface tension or interfacial tension between two liquids or between a liquid and a solid. The surfactant may be an organic compound that is amphiphilic, e.g. having hydrophobic groups and hydrophilic groups. Therefore, the surfactant may comprise both a water-insoluble component and a water-soluble component. The surfactant may be configured to diffuse in water and adsorb at interfaces between air and water or at an interface between oil and water, in case where water is mixed with oil. A water-insoluble hydrophobic group may extend out of a bulk water phase, into the air or into the oil phase, while the water-soluble head group may remain in the water phase.

As further used herein, the term "spray coating" may refer to an arbitrary process wherein an arbitrary material is deposited onto a surface by spraying. For this purpose, the material may specifically be provided in a fluid form, exemplarily as a suspension or as a solution. Further, the material may be accelerated towards the surface in form of particles, specifically in form of micrometer-sized particles. Exemplarily, the suspension or the solution may be applied via at least one nozzle, specifically via at lest one compressed air nozzle. Typically, a coating or a layer of the material may be generated by an accumulation of a plurality of the particles. A solvent of the material may evaporate at least to a large extend during the spray coating and/or after the spray coating such as in a separate drying process. However, other methods may also be feasible for applying the hydrophilic material such as blanket coating. The term "blanket coating" may refer to an arbitrary process, wherein one or more coating materials are distributed on a surface via one or more doctor blades or doctor knifes.

As further used herein, the term "surface section" may refer to a part, specifically to a distinct part, of a surface. Exemplarily, the term surface section may refer to at least 5%, at least 10%, at least 20%, at least 30%, at least 40%, at least 50%, at least 60%, at least 70%, at least 80%, at least 90%, at least 95%. However, other embodiments may be feasible. Further, the term surface section may refer to a whole surface, e.g. to 100% of the surface. As the at least one channel surface may be formed by at least one surface selected from the group consisting of: the substrate surface; the cover element surface; the receptacle surface, the surface section may be part of or may be the cover element surface, the receptacle surface and/or the substrate surface. However, the surface section may be part of or may be the at least one surface of the further layers or of the further elements such as of the foils as outlined above. Specifically, the surface section may be a continuous surface section. Thereby, the continuous surface section may extend form an opening of the channel which is configured to receive the sample of the body fluid to the test chemical. Exemplarily, the continuous surface section may be part of the receptacle surface. Specifically, the continuous surface section may correspond to at least 60%, preferably to at least 70%, more preferably to at least 80%, more preferably to at least 90%, most preferably to at least 95% of the receptacle surface. Specifically, the continuous surface section may be equivalent to the receptacle surface, e.g. the continuous surface section may correspond to 100% or at least to almost 100% of the receptacle surface. Further, exemplarily, the continuous surface section may correspond to at least 60%, preferably to at least 70%, more preferably to at least 80%, more preferably to at least 90%, most preferably to at least 95% of the cover element surface. Specifically, the continuous surface section may be equivalent to the cover element surface, e.g. the continuous surface section may correspond to 100% or at least to almost 100% of the cover element surface.

The term "adjacent" may generally refer to a property of an arbitrary element of being in proximity of another element. The term "adjacent" may also be referred to as "contiguous", "adjoint", "besides" or further related terms. Consequently, the element and the other element may be arranged in a neighboring fashion with respect to each other. Exemplarily, the element and the other element may be located in a plane and thus, the element and the other element may be arranged next to each other. Further, exemplarily, the element and the other element may be arranged opposite to each other. Thereby, at least one surface of the element and at least one surface of the other element may face each other. However, other embodiments may be feasible. The element and the other element may be in direct contact to each other, e.g. touch each other. Further, the term "adjacent" may also include that the element and the other element are arranged in an overlapping fashion. However, the element and the other element may be arranged in a distance to each other, e.g. may not touch each other. Specifically, the test chemical and the surface section may be located in one plane and thus, the test chemical and the surface section may be arranged next to each other. Thereby, the surface section may specifically be part of or may be the cover element surface. Specifically, the hydrophilic material may be applied such that the hydrophilic material forms, e.g. generates or establishes, a connection between the surface section and the test chemical. As further used herein, the term "connection" may refer to a link or a conjunction of two or more elements. Exemplarily, the hydrophilic material may exemplarily form a layer as will further be described below in more detail and the layer may be arranged between the test chemical and the surface section. Specifically, the layer may touch, e.g. be in direct contact with, at least one of the test chemical and the surface section. Thus, the connection may also be referred to as a "bridge". Further, the surface section may be part of or may be the receptacle surface and the hydrophilic material may be applied such that the hydrophilic material forms a connection between the surface section and the test chemical. Thereby, the test chemical may specifically in direct contact with the receptacle surface such as being at least partially received in the receptacle surface. Further, the hydrophilic material may also be applied such that the hydrophilic material forms a layer on the test chemical. Thus, the a hydrophilic layer may be formed which covers at least parts of the test chemical surface as well as at least parts of the receptacle surface and/or the cover element surface at the same time.

Herein, the hydrophilic layer may be a non-porous layer or a porous layer having a plurality of pores within the layer. The porous property of the hydrophilic layer may, in particular, be useful for advancing the transport of the body fluid to the test chemical. Especially, the porous hydrophilic layer may have a plurality of pores having an average pore size of 1 μm to 500 μm, preferably of 2 μm to 200 μm and most preferably of 5 μm to 100 μm. A pore size distribution may be adjustable by one or more parameters of the spray coating such as a spraying period, a concentration of the material provided as suspension or as solution, a design of the nozzle, a design of an opening of the nozzle, a distance between the nozzle and the substrate as well as an applied spray pressure. Specifically, an increase of the concentration may lead to an increased layer thickness and to smaller pore sizes. Further, an increase of the spraying period a number of layers lying on each other may increase.

Further, alternatively or additionally, the test chemical and the surface section may be arranged opposite to next other. Thereby, the surface section may specifically be part of or may be the receptacle surface and/or the substrate surface. The substrate surface may be at least partially identical to the receptacle surface. Thereby, the surface section may be arranged in a distance to the test chemical or may be in direct contact with the test chemical. In a particularly preferred embodiment, the distance between the substrate surface and the test chemical may be arranged in a manner that the capillary channel as described above may be formed. Consequently, the body fluid which may be transported within the capillary channel to the hydrophilic surface section may, thus, concurrently be transported to the test chemical. As a result, arranging the test chemical in an opposite fashion with respect to the surface section within the capillary channel may, thus, allow providing the body fluid to the test chemical in a fast and easy manner. In this particular embodiment, the hydrophilic layer may, preferably, be a non-porous layer since the non-porous layer may be sufficient for providing the body fluid to the test chemical.

Further, the hydrophilic material may be applied such that the surface section and a test chemical surface section, e.g. a part of at least one surface of the test chemical, is covered with the hydrophilic material. Specifically, the hydrophilic material may be applied such that further at least one test chemical surface section is covered with the hydrophilic material.

Specifically, the hydrophilic material may be applied such that at least one coating is formed on the at least one part. As further used herein, the term "coating" may refer to an arbitrary covering which is applied to at least one surface of an arbitrary object. The coating may cover the object completely or may only cover a part or parts of the object. The coating by the applied via a coating process wherein a material is provided as a fluid medium and the fluid medium may be distributed on the surface. Exemplarily, the coating process may be or may comprise the spray coating as described above or as will further be described below in more detail. Further, the hydrophilic material may be applied such that at least one hydrophilic layer, e.g. a layer with hydrophilic properties, is formed on the at least one part. As further used herein, the term "layer" may refer to an arbitrary covering of an arbitrary substrate, specifically of a flat substrate. The layer may specifically have a lateral extension exceeding its thickness by at least a factor of 2, at least a factor of 5, at least a factor of 10, or even at least a factor of 20 or more. Exemplarily, the hydrophilic layer may have a thickness of 0.5 μm to 50 μm, preferably of 0.75 μm to 20 μm, more preferably of 1 μm to 10 μm.

Further, the hydrophilic layer may be formed as a continuous hydrophilic layer. Thereby, the hydrophilic layer may be formed as one unit wherein the layer is at least to a large extent free from interruptions. Further, at least one mask may be placed on at least one part of the substrate, the cover element, the elongate receptacle, the test chemical before the spray coating is conducted. Thus, structures, specifically structures which exceed in a direction of extension of the test element, of layers of the hydrophilic material may be generated.

The hydrophilic material may be applied on the substrate before the test chemical and the cover element are placed on the substrate. Specifically, the hydrophilic material may be applied such that the elongate receptacle is covered with the hydrophilic material at least to a large extend. Additionally or alternatively, the test chemical and the cover element may form one single element such that the test chemical and the cover element are placed on the substrate as one unit. Thereby, the hydrophilic material may be applied to at least one surface of the element.

Further, at least one hydrophobic material may be applied to at least one further surface section. The further surface section may refer to a part, specifically to a distinct part, of the channel surface. The further surface section may be part of or may be the cover element surface, the receptacle surface and/or the substrate surface. However, the further surface section may be part of or may be the at least one surface of the further layers or of the further elements such as of the foils as outlined above. The further surface section may specifically be different from the surface section as described above or as will further be described below. However, the further surface section may also be at least partially identical to the surface section, e.g. the further surface section and the surface section may at least partially overlap. Specifically, the hydrophobic material may be applied via spray coating. Further, the hydrophobic material may be applied such that at least one hydrophobic layer is formed. Moreover, at least one further material may be applied to the at one further surface section. The further material may be selected from the group consisting of: cellulose, polyethylene glycol, polyvinyl alcohol, polyolefin, polyurethane, polyamide, polyimide, polyacrylate, polycarbonate, polyester, polyether, polyvinyl ether, polyvinyl ester, polyvinyl alcohol, and polysiloxane. The at least one further material be applied via spray coating. However, other embodiments may be feasible.

In a further aspect of the present invention, a test element for detecting at least one analyte in a body fluid is disclosed. The test element may specifically be an optical test element or an electrochemical test element comprising at least two electrodes. However, other embodiments may be feasible. The test element may be manufactured via the method for manufacturing a test element according as described above or as will further be described below in more detail.

The test element comprises at least one substrate having at least one elongate receptacle. Further, the test element comprises at least one test chemical. The test chemical covers the elongate receptacle at least partially. Further, the test element comprises at least one channel having a channel surface being formed by the cover element covering the elongate receptacle at least partially. Further, the test element comprises at least one hydrophilic material covering at least one surface section of the channel surface. The hydrophilic material is particularly a spray-coated layer or a blanket-coated layer. Further, the surface section is adjacent to the test chemical. With regard to the scope of the term "adjacent" reference may be made to the definition above.

The hydrophilic material may form a hydrophilic layer. Specifically, the hydrophilic layer may be a continuous hydrophilic layer as described above or as will further be described below. The hydrophilic material may be configured to enable a transport of the body fluid within the channel to the test chemical. As further used herein, the term "transport" may refer to a movement of an arbitrary element from a position to a further position, wherein the position is different from the further position. Specifically, the body fluid may be received by the channel via one opening of the channel, which may specifically be located at one end or near the one end the channel. Further, the body fluid may be transported within the channel to the test chemical. As outlined above, the channel may specifically be a capillary channel and the body fluid may be transported by capillary forces. Specifically, a fill time of the channel may be smaller than 5 s, preferably smaller than 3 s, more preferably smaller than 2 s, more preferably smaller than 1.5 s, most preferably smaller than 1 s.

At least one further surface section of the channel may comprise the at least one hydrophobic material. The hydrophobic material may be configured to prevent at least to a large extend or to reduce at least one of a wetting of the further surface section, a transport of the body fluid. Moreover, the test element may comprise at least one further layer selected from the group consisting of: a protective layer which is configured to provide a mechanical protection of at least one surface or of at least one part of the surface; a filter layer which is configured to separate the body fluid from undesired components a boundary layer which is configured for spatial separation of reactive components. The undesired components may specifically refer to medication, biological substances such as cells, specifically erythrocytes, proteins, polysaccharides, lipids.

In a further aspect of the present invention, a method for detecting at least one analyte in a body fluid is disclosed. The method comprises the method steps as given in the independent claims and as listed as follows. The method steps may be performed in the given order. However, other orders of the method steps are feasible. Further, one or more of the method steps may be performed in parallel and/or on a timely overlapping fashion. Further, one or more of the method steps may be performed repeatedly. Further, additional method steps may be present which are not listed The method comprises the following steps:

I. providing a test element as described above or as will further be described below;

II. placing a sample of the body fluid into at least one opening of the channel;

III. transporting the sample of the body fluid to the test chemical; and

IV. conducting at least one electrical measurement or at least one optical measurement thereby detecting at least one detection reaction between the test chemical and the sample of the body fluid.

In a further aspect of the present invention, a system for detecting at least one analyte in a body fluid is disclosed. The system comprises at least one test element as described above or as will further be described below in more detail. Further, the system comprises at least one measurement device adapted for performing at least one electrical measurement or at least one optical measurement using the test element. As further used herein, the term "measurement device" may refer to an arbitrary device, preferably an electronic device, which is be configured to detect at least one signal. The signal may be an optical signal and/or an electrochemical signal. The measuring device may be handled independently from the test element and may be adapted to interact with the test element in order to perform an analysis, such as by detecting the at least one signal. Thus, the term "measurement device" may often also be referred to as a measuring device, as an analytical device, as a meter or as a test device.

Further, a method for manufacturing a test element for detecting at least one analyte in a body fluid is disclosed. The method comprises the method steps as given in the independent claims and as listed as follows. The method steps may be performed in the given order. However, other orders of the method steps are feasible. Further, one or more of the method steps may be performed in parallel and/or on a timely overlapping fashion. Further, one or more of the method steps may be performed repeatedly. Further, additional method steps may be present which are not listed. The method comprises the following steps:

A) providing at least one substrate;

B) placing at least one test chemical on the substrate;

C) placing at least one hydrophilic element on the substrate, thereby covering the test chemical at least to a large extend;

D) coating the hydrophilic element with at least one hydrophilic layer at least partially.

Exemplarily, the substrate may have at least one elongate receptacle and the test chemical may be placed within the elongate receptacle. Specifically, the hydrophilic element may be placed in a manner that the elongate receptacle is covered with the hydrophilic element at least to a large extend. The hydrophilic element may be placed on the substrate such that at least one gap between the test chemical and at least one surface of the receptacle is filled with the hydrophilic element. Further, the hydrophilic element may be provided as an elastic element such as a foil. However, other embodiments may be feasible. Exemplarily, the foil may surround the test chemical at least to a large extend. Specifically, the coating of the hydrophilic element may be conducted such that gaps within the hydrophilic element are reduced at least to a large extend.

The proposed methods and devices provide many advantages over known devices and methods. Commonly, current methods for manufacturing a test element for detecting at least one analyte in a body fluid generally comprise conventional production methods such as dip coating or laminating individual foils. However, thereby, a number of limitations may be implied when it comes to producing defined three-dimensional multi-layered structures, producing the layers, specifically thin layers with a thickness of smaller than 10 μm, producing test elements with several adjacent, functionalized areas, wherein the areas are specifically smaller than 1 $mm^2$, producing sequences of layers having components which are not stable in a dissolved status or in a moist status as they would react with each other, manufacturing layers which are stable at temperatures which exceed room temperatures or producing layers having a three-dimensional structure, e.g. comprising pores and cavities.

Further, commonly, test elements comprising channels, specifically capillary channels which comprise hydrophobic foils such as PET foils, may show slow fill times of the channel. Specifically, a sample, specifically a body fluid, may not be transported within the capillary because of missing hydrophilic surfaces.

Due to manufacturing tolerances, which may specifically emerge during laminating of test elements, a gap may be generated when diverse foils may be laminated as covering of the channel. Exemplarily, a gap may emerge between a test chemical layer and a cover element. Such gaps may not provide a continuous hydrophilic surface, and a capillary force may not be strong enough to enable a transport of the body fluid within the gap.

On the contrary, by applying the method for manufacturing a test element for detecting at least one analyte in a body fluid according to the present invention, the spray coating, specifically spray processes, for application of individual functional layers within the test element, specifically a single capillary test element, may be applied. By applying a hydrophilic layer, specifically a hydrophilic porous layer, which may be applied in an area of the gap as outlined above or continuously within the channel the transport problem may be overcome. Specifically, the transport of the body fluid may be feasible from an opening of the channel which is configured to receive the body fluid to another end of the channel where the test chemical may be located.

Specifically, the spray coating may be applied in order to generate a hydrophilic bridge between the surface section of the channel surface, specifically of a capillary surface, and the test chemical, specifically the test chemical adjacent to the surface section. Without such a bridge, a gap would remain between the test chemical, specifically between the test chemical surface, and the surface section, specifically the capillary surface, which may prevent at least to a large extent or at least partially the sample, specifically the sample of the body fluid, specifically the sample of blood, from wetting the test chemical surface.

The method for manufacturing a test element for detecting at least one analyte in a body fluid according to the present invention may enable a forming of functional layers onto the test element, specifically on the channel surface of the channel of the test element, specifically via the spray coating. Thus, the fine properties of layers may be adjusted such as a structure, a porosity, wetting properties or an ability to transport fluids, specifically the body fluid. Moreover, it may be feasible to generate multiple thin layers within individual layer thicknesses of smaller than micrometers. Moreover, it may be feasible to generate several layers which are functionalized and adjacent to each other. Further, it may be feasible to generate complex three-dimensional structures via the spraying process.

The spray coating may also be useful for treating the hydrophilic surface, specifically a hydrophilic area, and/or the hydrophobic surface, specifically a hydrophobic area, within the test element, specifically within a disposable test element, in order to enhance the transport of the body fluid or of a liquid sample, specifically within the channel, specifically within the capillary channel. Further, the spray coating may be useful for enhancing a flow velocity in the test element, specifically in the capillary test element, having hydrophobic test chemical areas. Further, a robust protection against mechanical influences e.g. of a surface of the test element, specifically of the test chemical surface, may be generated.

The spray coating may specifically be used to generate individual functional layers on the test element, specifically on at least one surface section of the channel surface. Specifically, a solution, specifically a homogeneous solution or a suspension may be applied via the spray coating. The solution or the suspension may comprise components, specifically active components of a respective layer, such as polymers, reactive components, filling materials. The components may be dissolved in the solvent or may be suspended as particles, specifically as finely dispersed particles in the solvent. The layers may form continuous layers or may be layers with a porous structure.

The solution or the suspension may be applied via the nozzle, specifically via the compressed air nozzle. The solvent may evaporate directly during the spray coating or may be removed at least to a large extent via separate drying processes afterwards. Via the usage of the mask and/or via an arrangement of the nozzles defined areas of the test element, specifically of the channel surface may be coated. Additionally, connections between individual areas or structures of the test element, such as between the channel surface and the test chemical, may be generated. The further layers which may specifically comprise functional properties may be applied onto the channel surface via spray coating. The further layers may specifically comprise the test chemical layer. The test chemical layer may comprise reactive components such as enzymes, specifically enzymes for detection of glucose in blood. Further, the further layers may comprise the filter layers which are configured to separate a sample, specifically the body fluid, from undesired components such as a medication, biological substances such as cells, specifically red blood bodies, proteins, or lipids. Moreover, the further layers may comprise the protective layer which is configured for protection against mechanical influences. Thereby, a porous structure, specifically a porous structure comprising at least one polymer at least one ceramic material, may be applied via spray coating. Additionally, the protective layer may serve as a boundary against gas or gaseous materials such as moisture, organic substances, gaseous softening agents or reactive gases such as ozone. Further, the further layers may comprise at least one boundary layer which is configured for spatial separation of reactive components, specifically to prevent at least to a large extent a mixing of diverse components during the manufacturing process or to immobilize at least one component during a detection reaction. Further, the further layers may be configured to modify wetting properties of the channel surface. Exemplarily, hydrophilic and/or hydrophobic layers may be applied via spray coating. Thereby, the transport of the body fluid through the channel, specifically through the capillary channel, may be enabled. Further, the hydrophilic area may serve as a bridge between the channel surface and the test chemical.

Summarizing the findings of the present invention, the following embodiments are preferred:

Embodiment 1

A method for manufacturing a test element for detecting at least one analyte in a body fluid, wherein the method comprises the following steps:

a) providing at least one substrate having at least one elongate receptacle on a surface of the substrate;
b) placing at least one test chemical on the substrate in a manner that the test chemical covers a partition of the elongate receptacle;
c) placing at least one cover element on the substrate such that the cover element covers the elongate receptacle partially, whereby a channel having a channel surface is formed;

wherein at least one hydrophilic material is applied in a manner that at least one surface section of the channel surface is covered with the hydrophilic material, wherein the surface section is adjacent to the test chemical.

Embodiment 2

The method according to the preceding embodiment, wherein the surface section is a continuous surface section extending from an opening of the channel to the test chemical.

Embodiment 3

The method according to any one of the preceding embodiments, wherein the hydrophilic material is applied via one of spray coating or blanket coating.

Embodiment 4

The method according to any one of the preceding embodiments, wherein the at least one channel surface is formed by at least one surface selected from the group consisting of: the substrate surface; a cover element surface of the cover element; a receptacle surface of the elongate receptacle.

Embodiment 5

The method according to the preceding embodiment, wherein the substrate surface is at least partially identical to the receptacle surface.

Embodiment 6

The method according to any one of the two preceding embodiments, wherein the surface section covered by the hydrophilic material is part of the cover element surface.

Embodiment 7

The method according to the preceding embodiment, wherein the hydrophilic material is applied such that the hydrophilic material forms a connection between the surface section and the test chemical.

Embodiment 8

The method according to any one of the four preceding embodiments, wherein the surface section covered by the hydrophilic material is part of the receptacle surface.

Embodiment 9

The method according to the preceding embodiment, wherein the hydrophilic material is applied such that the hydrophilic material forms a connection between the surface section and the test chemical.

Embodiment 10

The method according to any one of the preceding embodiments, wherein the hydrophilic material is applied such that further at least one test chemical surface section of at least one test chemical surface of the test chemical is covered with the hydrophilic material.

Embodiment 11

The method according to any one of the preceding embodiments, wherein the hydrophilic material is applied such that at least one hydrophilic layer is formed on the surface section.

Embodiment 12

The method according to the preceding embodiment, wherein the hydrophilic layer has a thickness of 0.5 μm to 50 μm, preferably of 0.75 μm to 20 μm, more preferably of 1 μm to 10 μm.

Embodiment 13

The method according to the preceding embodiment, wherein the hydrophilic layer is formed as a continuous hydrophilic layer.

Embodiment 14

The method according to any one of the preceding embodiments, wherein the hydrophilic material is applied such that at least one hydrophilic coating is formed on the surface section.

Embodiment 15

The method according to any one of the preceding embodiments, wherein the hydrophilic material is applied on the substrate before the test chemical and the cover element are placed on the substrate.

Embodiment 16

The method according to the preceding embodiment, wherein the hydrophilic material is applied such that the elongate receptacle is covered with the hydrophilic material at least to a large extent.

Embodiment 17

The method according to any one of the preceding embodiments, wherein the test chemical and the cover element form one single element such that the test chemical and the cover element are placed on the substrate as one unit.

Embodiment 18

The method according to the preceding embodiment, wherein the hydrophilic material is applied to at least one surface of the element.

Embodiment 19

The method according to any one of the preceding embodiments, wherein the hydrophilic material is provided as a suspension or as a solution.

Embodiment 20

The method according to the preceding embodiment, wherein the suspension or the solution is applied via at least one nozzle, specifically via at least one compressed air nozzle.

Embodiment 21

The method according to any one of the two preceding embodiments, wherein the suspension or the solution comprises at least one solvent, wherein the solvent evaporates while the spray coating is conducted or is removed after conducting the spray coating via at least one drying process.

Embodiment 22

The method according to any one of the preceding embodiments, wherein at least one mask is placed on at least one part of the substrate, the cover element, the elongate receptacle, the test chemical before the spray coating is conducted.

Embodiment 23

The method according to any one of the preceding embodiments, wherein the hydrophilic material comprises at least one material selected from the group consisting of: a polymer; a surface-active substance, a filling material, and a reactive component.

Embodiment 24

The method according to the preceding embodiment, wherein the polymer is selected from the group consisting of: cellulose, polyethylene glycol, polyvinyl alcohol, polyolefin, polyurethane, polyamide, polyimide, polyacrylate, polycarbonate, polyester, polyether, polyvinyl ether, polyvinyl ester, polyvinyl alcohol, and polysiloxane.

Embodiment 25

The method according to any one of the two preceding embodiments, wherein the surface-active substance is a surfactant, specifically a hydrophilic surfactant, specifically an anionic surfactant.

Embodiment 26

The method according to any one of the preceding embodiments, wherein the cover element is placed adjacent to the test chemical.

Embodiment 27

The method according to any one of the preceding embodiments, wherein the cover element is placed such that the test chemical is at least partially covered by the cover element.

Embodiment 28

The method according to any one of the preceding embodiments, wherein the cover element is a cover foil.

Embodiment 29

The method according to the preceding embodiment, wherein the cover foil is at least partially manufactured of polyethylene terephthalate; polycarbonate; polystyrene; polyvinyl chloride; polypropylene; poly(methyl methacrylate); polyurethane; polyester.

Embodiment 30

The method according to any one of the preceding embodiments, wherein the cover element has a thickness perpendicular to a direction of extension of the test element of 10 μm to 200 μm, preferably of 30 μm to 150 μm, more preferably of 50 μm to 100 μm.

Embodiment 31

The method according to any one of the preceding embodiments, wherein the substrate is at least partially manufactured of at least one hydrophobic material.

Embodiment 32

The method according to any one of the preceding embodiments, wherein the substrate is manufactured of at least one material selected from the group consisting of: a thermoplastic polymer, specifically polyethylene terephthalate.

Embodiment 33

The method according to any one of the preceding embodiments, wherein the elongate receptacle has a length of 3 mm to 50 mm, preferably of 5 mm to 30 mm, more preferably of 10 mm to 20 mm, most preferably of 12 mm.

Embodiment 34

The method according to any one of the preceding embodiments, wherein the elongate receptacle is formed by placing at least one foil, specifically at least one adhesive foil, on the substrate.

Embodiment 35

The method according to the preceding embodiments, wherein the foil comprises at least one opening extending in a direction of extension of the foil, wherein the elongate receptacle is formed by the opening.

Embodiment 36

The method according to any one of the two preceding embodiments, wherein the foil has a thickness of 20 μm to 100 μm, preferably of 30 μm to 90 μm, more preferably of 50 μm to 80 μm, most preferably of 70 μm.

Embodiment 37

The method according to any one of the three preceding embodiments, wherein the adhesive foil is a double-sided adhesive foil.

Embodiment 38

The method according to any one of the preceding embodiments, wherein the elongate receptacle has a width of 0.1 mm to 10 mm, preferably a width of 0.5 mm to 5 mm, more preferably a width of 1 mm to 2 mm.

Embodiment 39

The method according to any one of the preceding embodiments, wherein the elongate receptacle has a thickness of 20 μm to 100 μm, preferably of 30 μm to 90 μm, more preferably of 50 μm to 80 μm, most preferably of 70 μm.

Embodiment 40

The method according to any one of the preceding embodiments, wherein at least one hydrophobic material is applied to at least one further surface section.

Embodiment 41

The method according to the preceding embodiments, wherein the hydrophobic material is applied via spray coating.

Embodiment 42

The method according to any one of the two preceding embodiments, wherein the hydrophobic material is formed.

Embodiment 43

The method according to any one of the preceding embodiments, wherein the test chemical forms a layer on the substrate.

Embodiment 44

The method according to the preceding embodiment, wherein the test chemical is provided via spray coating.

Embodiment 45

The method according to any one of the preceding embodiments, wherein the test chemical is provided as a test chemical element.

Embodiment 46

The method according to the preceding embodiment, wherein test chemical element is manufactured by depositing the test chemical on at least one test chemical substrate.

Embodiment 47

The method according to any one of the preceding embodiments, wherein at least one further material is applied to at least one further surface section, wherein the further material is selected from the group consisting of: cellulose, polyethylene glycol, polyvinyl alcohol, polyolefin, polyurethane, polyamide, polyimide, polyacrylate, polycarbonate, polyester, polyether, polyvinyl ether, polyvinyl ester, polyvinyl alcohol, and polysiloxane.

Embodiment 48

The method according to the preceding embodiment, wherein the at least one further material is applied via spray coating.

Embodiment 49

A test element for detecting at least one analyte in a body fluid, wherein the test element comprises:

at least one substrate having at least one elongate receptacle;

at least one test chemical, wherein the test chemical covers the elongate receptacle at least partially;

at least one channel having a channel surface being formed by the cover element covering the elongate receptacle partially;

wherein the test element further comprises at least one hydrophilic material covering at least one surface section of the channel surface, wherein the surface section is adjacent to the test chemical.

Embodiment 50

The test element according to the preceding embodiments, wherein the test element is obtained via the method for manufacturing a test element according to any one of the preceding embodiments referring to a method for manufacturing a test element.

Embodiment 51

The test element according to any one of the preceding embodiments referring to a test element, wherein the test element is a test strip.

Embodiment 52

The test element according to any one of the preceding embodiments referring to a test element, wherein a fill time of the channel is smaller than 5 s, preferably smaller than 3 s, more preferably smaller than 2 s, more preferably smaller than 1.5 s, most preferably smaller than 1 s.

Embodiment 53

The test element according to any one of the preceding embodiments referring to a test element, wherein the hydrophilic material is configured to enable a transport of the body fluid within the channel to the test chemical.

Embodiment 54

The test element according to any one of the preceding embodiments referring to a test element, wherein the channel is a capillary channel.

Embodiment 55

The test element according to any one of the preceding embodiments referring to a test element, wherein the test element comprises at least one further layer selected from the group consisting of: a protective layer which is configured to provide a mechanical protection of at least one surface or of at least one part of the surface; a filter layer which is configured to separate the body fluid from undesired components, a boundary layer which is configured for spatial separation of reactive components.

Embodiment 56

The test element according to any one of the preceding embodiments referring to a test element, wherein the test element is an optical test element or an electrochemical test element comprising at least two electrodes.

Embodiment 57

A method for detecting at least one analyte in a body fluid, the method comprising the following steps:

I. providing a test element according to any one of the preceding embodiments referring to a test element;

II. placing a sample of the body fluid into at least one opening of the channel;

III. transporting the sample of the body fluid to the test chemical; and

IV. conducting at least one electrical measurement or at least one optical measurement thereby detecting at least one detection reaction between the test chemical and the sample of the body fluid.

Embodiment 58

A system for detecting at least one analyte in a body fluid, the system comprising at least one test element according to any one of the preceding embodiments referring to a test element, the system further comprising at least one measurement device adapted for performing at least one electrical measurement or at least one optical measurement using the test element.

Embodiment 59

A method for manufacturing a test element for detecting at least one analyte in a body fluid, wherein the method comprises the following steps:

A) providing at least one substrate;

B) placing at least one test chemical on the substrate;

C) placing at least one hydrophilic element on the substrate, thereby covering the test chemical at least to a large extent; and D) coating the hydrophilic element with at least one hydrophilic layer at least partially.

Embodiment 60

The method according the preceding embodiment, wherein the substrate has at least one elongate receptacle.

Embodiment 61

The method according to the preceding embodiment, wherein the test chemical is placed within the elongate receptacle.

Embodiment 62

The method according to any one of the two preceding embodiments, wherein the hydrophilic element is placed in a manner that the elongate receptacle is covered with the hydrophilic element at least to a large extent.

Embodiment 63

The method according to the preceding embodiment, wherein the hydrophilic element is placed on the substrate such that at least one gap between the test chemical and at least one surface of the elongate receptacle is filled with the hydrophilic element at least to a large extent.

Embodiment 64

The method according to any one of the five preceding embodiments, wherein the hydrophilic element is an elastic element, specifically an elastic foil.

Embodiment 65

The method according to the preceding embodiment, wherein the foil surrounds the test chemical at least to a large extent.

Embodiment 66

The method according to any one of the seven preceding embodiments, wherein the coating of the hydrophilic element is conducted such that gaps within the hydrophilic element are reduced at least to a large extent.

Embodiment 67

The method according to any one of the eight preceding embodiments, wherein step D) is conducted via at least one method selected from the group consisting of: spray coating; blanket coating.

SHORT DESCRIPTION OF THE FIGURES

Further optional features and embodiments of the invention will be disclosed in more detail in the subsequent description of preferred embodiments, preferably in conjunction with the dependent claims. Therein, the respective optional features may be realized in an isolated fashion as well as in any arbitrary feasible combination, as the skilled person will realize. The scope of the invention is not restricted by the preferred embodiments. The embodiments are schematically depicted in the Figures. Therein, identical reference numbers in these Figures refer to identical or functionally comparable elements.

DETAILED DESCRIPTION OF THE EMBODIMENTS

Figure 1A:
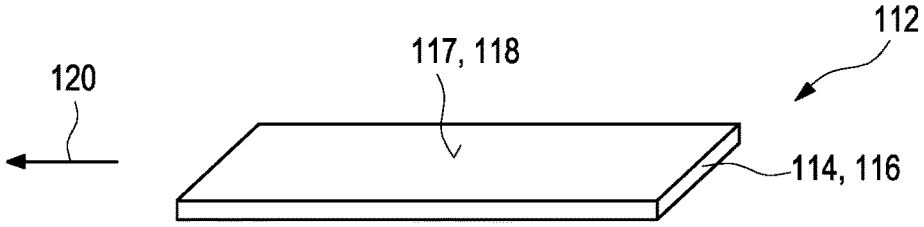
FIGS. 1A to 1E show an exemplary embodiment of a method for manufacturing a test element, wherein different intermediate products and the test element are shown in different perspective views.
Figure 1B:
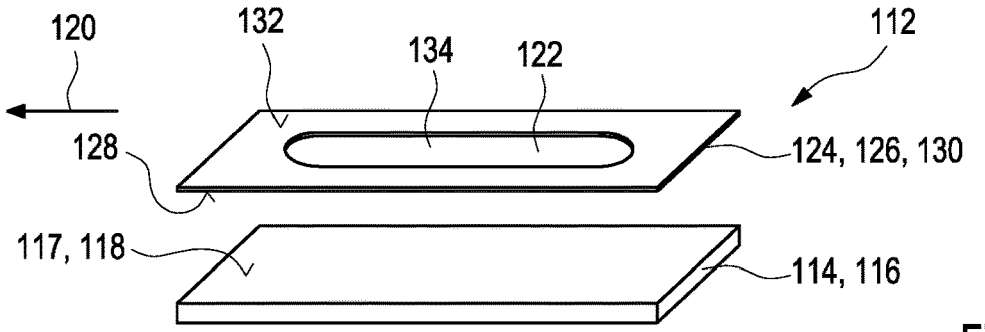
Figure 1C:
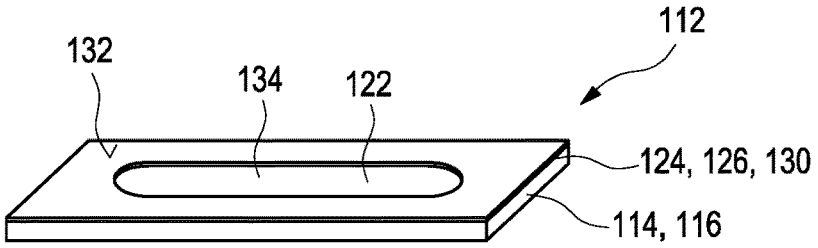
Figure 1D:
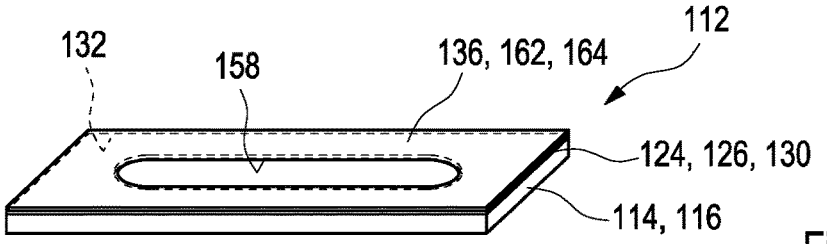
Figure 1E:
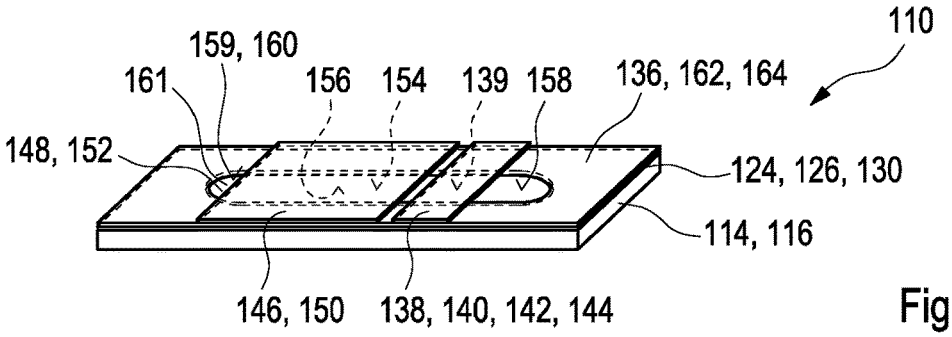

FIGS. 1A to 1E show an exemplary embodiment of a method for manufacturing a test element 110. The test element 110 is illustrated in FIG. 1E in a perspective view. In FIGS. 1A to 1D, different intermediate products 112 of the test element 110 are shown. The intermediate products 112 are illustrated in different perspective views as well.

In a first step, as illustrated in FIG. 1A, at least one substrate 114 is provided. The substrate 114 may specifically be a flat substrate 116 having at least one flat surface 117. A surface of the substrate 114 may also be referred to as substrate surface 118. The substrate surface 118 may specifically extend along a direction of extension 120 of the substrate 114. The substrate 114 may at least partially be manufacturing of at least one hydrophobic material such as polyethylene terephthalate. However, other materials may be feasible. Further, the substrate 114 may have an elongate shape. Exemplarily, the substrate 114 may be strip-shaped.

In a further step, as illustrated in FIGS. 1B and 1C, at least one elongated receptacle 122 may be formed on the substrate surface 118. As illustrated in FIG. 1B, at least one foil 124, specifically at least one adhesive foil 126, may be placed on the substrate 114, specifically on the substrate surface 118 of the substrate 114. The adhesive foil 126 may comprise at least one adhesive surface 128 facing the substrate 114, specifically the substrate surface 118 of the substrate 114. Specifically, the adhesive foil 126 may be a double-sided adhesive foil 130. The double-sided adhesive foil 130 may comprise at least one further adhesive surface 132. The foil 124 may comprise at least one opening 134. The opening 134 may extend in the direction of extension 120. The foil 124 may have a thickness of 20 μm. However, other dimensions may be feasible. The foil 124 may be placed onto the substrate 114. Thereby, the foil 124 may be fixedly attached to the substrate 114 via the adhesive surface 128 of the foil 124. Thereby, the elongate receptacle 122 may be formed, specifically by the opening 134 of the foil 124 and the surface 118 of the substrate 114. The elongate receptacle may have a width of 0.1 mm to 10 mm. Further, the elongate receptacle 122 may have a thickness of 70 μm. However, other dimensions may be feasible.

In a further step, as illustrated in FIG. 1D, at least one hydrophilic material 136 may be applied via spray coating. Specifically, the hydrophilic material 136 may be applied on the substrate 114, specifically on the substrate surface 118. Thereby, the hydrophilic material 136 may be applied such that the elongate receptacle 122 is covered with the hydrophilic material 136 at least to a large extent. The hydrophilic material 136 may specifically be provided as a suspension or as a solution, and the suspension or the solution may be applied via at least one nozzle (not shown). The suspension or the solution may comprise at least one solvent and the solvent may evaporate during the spray coating or may be removed after conducting the spray coating via at least one drying process. Specifically, the solvent may comprise at least one material selected from the group consisting of: a polymer, a surface-active substance, a filling material, a reactive component. However, other embodiments may be feasible. The hydrophilic material 136 may be applied such that at least one hydrophilic layer 162 is formed on the surface section 160. The hydrophilic layer 162 may have a thickness of 1 μm to 10 μm. However, other dimensions may be feasible. Specifically, the hydrophilic layer 162 may be formed as a continuous hydrophilic layer 164.

In a further step, as illustrated in FIG. 1E, at least one test chemical 138 is placed on the substrate 114, such that the test chemical 138 covers a partition 139 of the elongate receptacle 122. The test chemical 138 may be provided as a test chemical element 140. Exemplarily, the test chemical element 140 may be manufactured by depositing the test chemical 138 on at least one test chemical substrate 142. Thus, the test chemical element 140 may be a rigid element 144 which may lay flat on the foil 124. Specifically, the foil 124 may be a double-sided adhesive foil 130 and the test chemical element 140 may be fixedly attached to the double-sided adhesive foil 130 by the further adhesive surface 132.

Further, as illustrated in FIG. 1E, at least one cover element 146 may be placed on the substrate 114, specifically on the substrate surface 118 of the substrate 114. The cover element 146 may cover the elongate receptacle 122 at least partially such that a channel 148 is formed. The cover element 146 may specifically have a flat shape and extend along the direction of extension 120. The cover element 146 may specifically be a rigid element 150 and may lay flat on the foil 124. Specifically, the foil 124 may be a double-sided adhesive foil 130, and the cover element 164 may be fixedly attached to the double-sided adhesive foil 130 via the further adhesive surface 132. The cover element 146 may have a shape which corresponds to a shape of the substrate 114 such as a strip shape and/or a bar shape. Further, specifically, the cover element 146 may have a width which is equivalent to the width of the substrate 114. Further, the cover element 146 may have a length which is smaller than a length of the elongate receptacle, such as by a factor of 1.7. However, other embodiments may be feasible. Specifically, the cover element may at least partially be manufactured of polyethylene glycol. Specifically, the cover element 146 may be placed adjacent to the test chemical 138.

The channel 148 may specifically be a capillary channel 152. The channel 148 may comprise at least one channel surface 154. The at least one channel surface 154 may be formed by at least one surface selected from the group consisting of the substrate surface 118 of the substrate 114, a cover element surface 156 of the cover element 146, a receptacle surface 158 of the elongate receptacle 122. Thereby, the receptacle surface 158 may be at least partially identical to the substrate surface 118. The surface section 160 may specifically be a continuous surface section 159 extending from an opening 161 of the channel 148 to the test chemical 138. At least one surface section 160 of the at least one channel surface 154 of the channel 148 may be covered with the hydrophilic material. The surface section 160 may be adjacent to the test chemical 138. Specifically, the surface section 160 may be part of the receptacle surface 158. Thereby, the hydrophilic material 136 may specifically be applied such that the hydrophilic material 136 forms a connection between the surface section 160 and the test chemical 138. The channel 148 may have a length of 10 mm to 15 mm. A fill time of the channel 148 may be smaller than 5 seconds, preferably smaller than 2 seconds, more preferably smaller than 1.5 seconds.

Figure 2A:
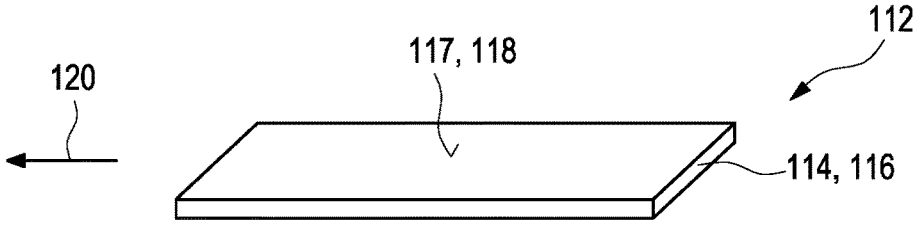
FIGS. 2A to 2F show a further exemplary embodiment of a method for manufacturing a test element, wherein different intermediate products and the test element are shown in different perspective views.
Figure 2B:
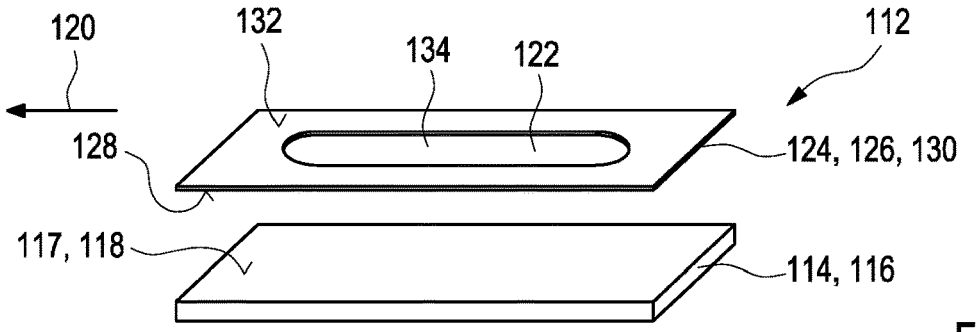
Figure 2C:
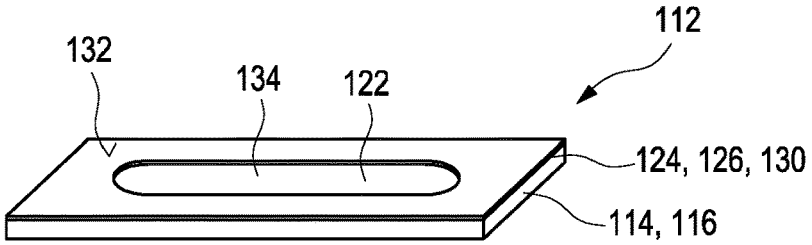

FIGS. 2A to 2F show a further exemplary embodiment of a method for manufacturing a test element 110. The test element 110 may be depicted in FIG. 2F, and different intermediate products 112 are illustrated in FIGS. 2A to 2E. Firstly, as illustrated in FIG. 2A, the substrate 114 may be provided and the substrate 114 may be covered with the adhesive foil 126 comprising the opening 134. By placing the adhesive foil 126 onto the substrate 114, the elongate receptacle 122 may be formed. These steps may correspond at least in large parts to the steps of the method for manufacturing a test element as illustrated in FIGS. 1A to 1E. Specifically, the steps as illustrated in FIGS. 2A to 2C may correspond to the steps as illustrated in FIGS. 1A to 1C. Thus, reference may be made to the description of FIGS. 1A to 1C above.

Figure 2D:
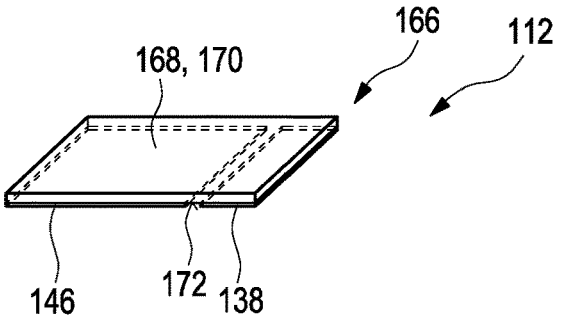

In a further step, as illustrated in FIG. 2D, the test chemical 138 and the cover element 146 may be provided. Specifically, the test chemical 138 and the cover element 164 may form a single element 166. Exemplarily, the test chemical 138 and the cover element 146 may be fixedly attached to a support element 168. The support element 168 may specifically be provided as a flat substrate 170. Therefore, the support element 168 may comprise at least one flat surface 172 and the test chemical 138 and the cover element 146 may be fixedly attached to the support element 168 by being placed on the flat surface 142 and adjacent to each other.

Figure 2E:
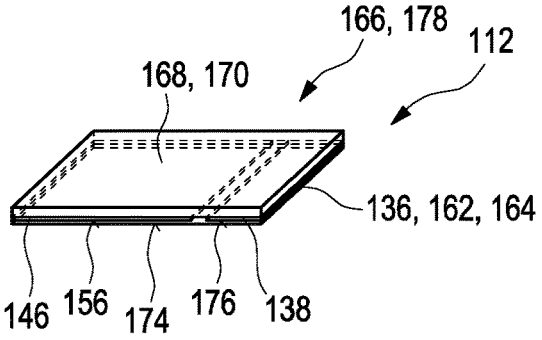

In a further step, as illustrated in FIG. 2E, the hydrophilic material 136 may be applied to at least one surface 174 of the element 166. Specifically, the surface 174 may comprise the cover element surface 156 and a test chemical surface 176. Specifically, the hydrophilic layer 162 may be formed on the surface 174. Specifically, the hydrophilic material 136 may be provided such that the hydrophilic material 136 covers the test chemical surface 176 as well. Thus, the surface section 160 may specifically be formed by the cover element surface and the test chemical surface.

Figure 2F:
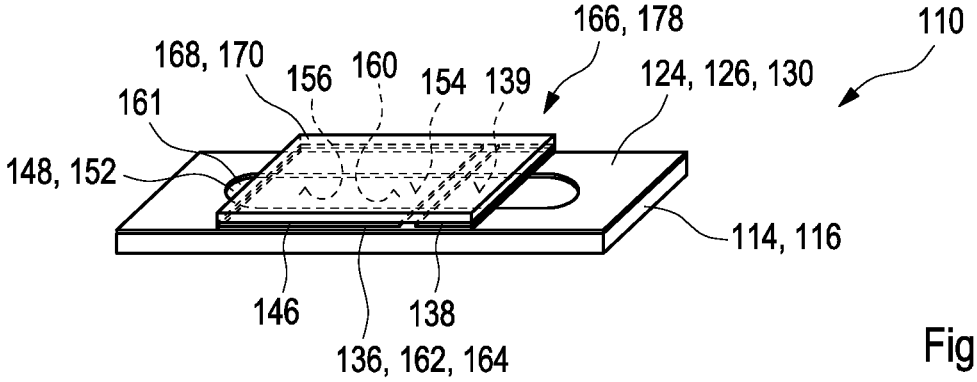

In a further step, as shown in FIG. 2F, the cover element 146 and the test chemical 138 are placed onto the substrate 114. Thereby, the element 166 may be placed onto the substrate 114 as one unit 178. Specifically, the foil 124 may be the double-sided adhesive foil 130 and the element 166 may be fixedly attached to the substrate 114 via the double-sided adhesive foil 130. The channel 148 may be formed.

Commonly, the test chemical, specifically the test chemical comprising one or more enzymes, comprises hydrophobic surfaces. This may reduce or limit a transport of the body fluid within the channel 148, specifically to the test chemical 138. Via applying or forming the hydrophilic layer 162 onto the test chemical 138, a transport of the body fluid may be accelerated. Within an experiment, blood was applied as body fluid, specifically blood with a high content of hematocrit, specifically with a portion of 65% of hematocrit. By applying the hydrophilic material 136, the blood having a high hematocrit portion may be transported within the channel 148, specifically to the test chemical 138.

In an experiment, different times were tested which correspond to a period of time how long the hydrophilic material was applied to the surface section 160. At a spray time of 20 seconds, a fill time of 3.4 seconds was reached, by applying a spray time of 40 seconds, a fill time of 4.9 seconds was reached, by applying a spray time of 80 seconds, a fill time of 8.6 seconds was reached. On the contrary, by not applying the hydrophilic material onto the channel surface at all, the sample did not reach the test chemical at all, which virtually corresponds to a fill time of infinity. Additionally, the hydrophilic layer which may be formed on the test chemical surface comprising one or more enzymes may serve as a protection layer at the same time. Specifically, the hydrophobic layer which may be formed as a protection layer may provide a protection against mechanical influences, specifically as the hydrophilic layer may have a flexible, porous structure which may be more stretch-resistant than the test chemical surface.

Figure 3A:
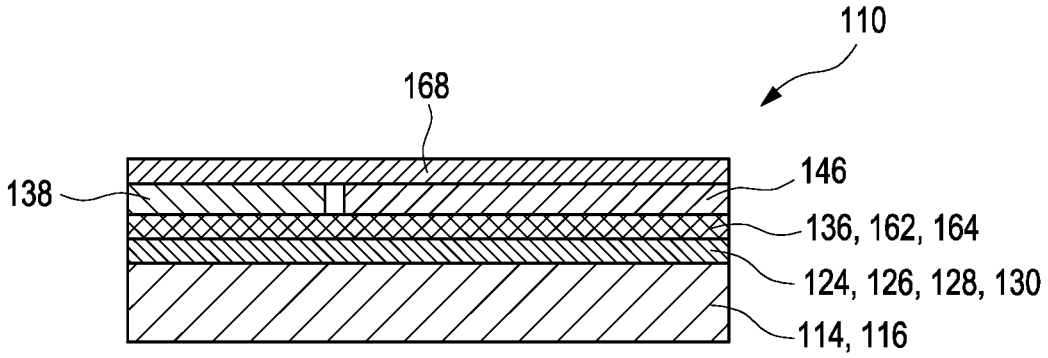
FIGS. 3A to 3B show an exemplary embodiment of a test element in a cross-sectional view (FIG. 3A) and in a top-view (FIG. 3B)
Figure 3B:
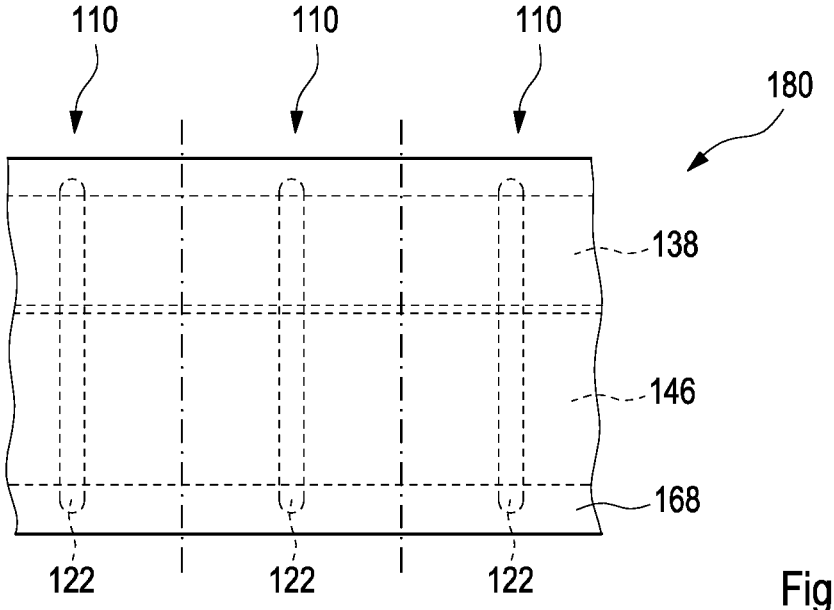

In FIGS. 3A and 3B, an exemplary embodiment of a test element 110 is shown in a cross-sectional view (FIG. 3A) and in a top view (FIG. 3B). The test element 110 as illustrated in FIGS. 3A and 3B corresponds at least in large parts to the test element as illustrated in FIG. 1E. Thus, reference may be made to the description of FIG. 1E above.

The channel 148 may have a length of 20 mm, a width of 1.5 mm and a height of 70 μm. Further, the substrate 114 and the cover element 146 may be made of polyethylene terephthalate and may have a thickness of 350 μm and 175 μm, respectively. The hydrophilic material may be provided as a solution comprising 2% of polycarbonate urethane and 0.2% of dioctyl sulfosuccinate in tetrahydrofuran.

The hydrophilic material 136 may comprise at least one surfactant such as docusate and/or trisiloxane. The hydrophilic material 136 may further comprise at least one polymer. In an experiment, the surfactant docusate may be applied via spray coating with a spray time of 10 seconds. Thereby, a time how long the body fluid takes from one opening 161 of the channel 148 to the test chemical 138 was determined to 1.7 seconds. A wait time was determined to 2.27 seconds. Thereby, the term "wait time" may refer to a time for the body fluid to overcome the gap between the channel 148 and the test chemical 138. In a further experiment, the surfactant trisiloxane was applied via spray coating with a spray time of 40 seconds. The time for transport within the channel 148 was determined to 1.27 seconds and a wait time was determined to 0.7 seconds. In a further experiment, the surfactant trisiloxane was applied via spray coating with a spray time of 20 seconds. Thereby, the time for transport through the channel was determined to 0.99 seconds, and a wait time was determined to 0.29 seconds. In a further experiment, the surfactant trisiloxane was applied via spray coating with a spray time of 2 seconds. Thereby, a time for transport of the body fluid within the channel 148 was determined to 0.67 seconds. On the contrary, during a reference measurement wherein no surfactant or hydrophilic material was applied, the time of transport of the body fluid within the channel 148 was determined to 4.53 seconds.

Commonly, in order to bridge the gap, an additional aluminum oxide foil may be applied. On the contrary, in the framework of the above described experiments, the hydrophilic material may be applied such that the channel and the test chemical is covered with the hydrophilic material within one step and a transfer of the body fluid to the test chemical may be feasible, thus allowing to considerably reduce the wait time, such as down to a value of 0.29 s.

In further experiments, different fill times have been determined depending on a presence of the hydrophilic material on the channel surface. As used above, the fill time refers to the time required to fill the channel with the body fluid. Without application of a hydrophilic material on the channel surface at all, the fill time was determined as 5.04 seconds. On the contrary, by applying the hydrophilic material, the fill time was determined as 4.78 seconds.

Further, the hydrophilic material may comprise at least one polymer, such as polycarbonate urethane. The polymer may have a surface which corresponds to fleece and may lead to an improvement of a wetting as well as of the fill time.

As illustrated in FIG. 3B, the test element 110 may be manufactured as a roll good 180. Specifically, the adhesive foil 126 (not shown in FIG. 3B) as well as the test chemical 138 and the cover element 146, may be placed on top of the surface 114 and the substrate 114 may provide space for several units of the test chemical 138 such that a plurality of test elements 110 may be generated by cutting the substrate 114 into distinct pieces. Consequently, an assembly comprising the substrate 114, the adhesive foil 126, the test chemical 138 and the cover element 146 may be manufactured as a roll and may be cut into individual test elements 110 thereafter.

Figure 4A:
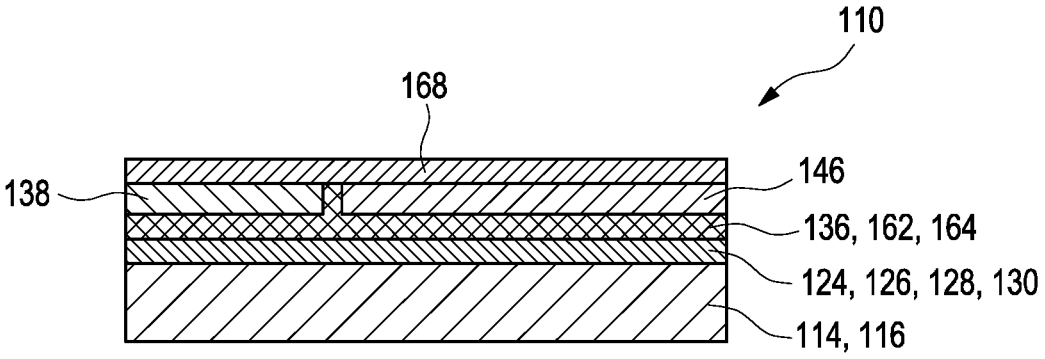
FIG. 4A to 4B show a further exemplary embodiment of a test element in a cross-sectional view (FIG. 4A) and in a top-view (FIG. 4B)
Figure 4B:
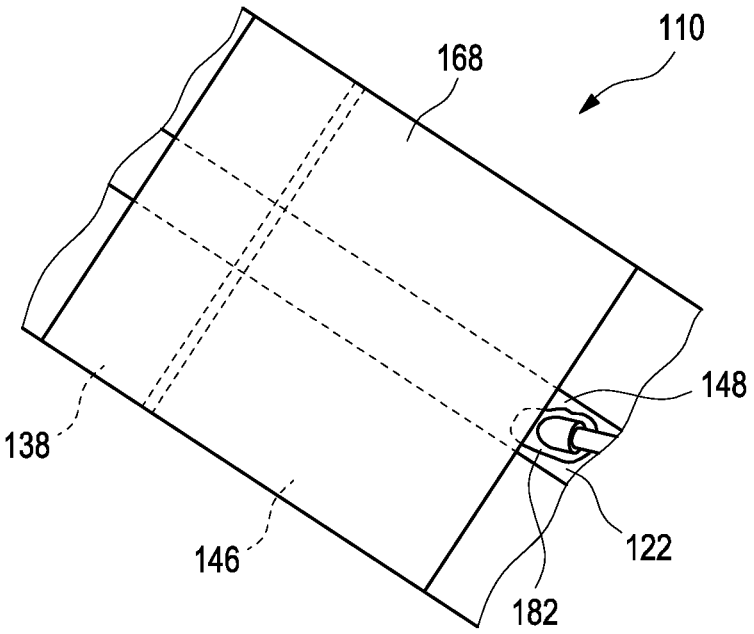

In FIGS. 4A to 4B, a further exemplary embodiment of a test element 110 is shown in a cross-sectional view (FIG. 4A) and in a top view (FIG. 4B). The test element 110 as illustrated in FIGS. 4A and 4B corresponds at least in large parts to the test element 110 as illustrated in FIG. 2F. Thus, reference may be made to the description of FIG. 2F above.

The hydrophilic material 136 may comprise Bindzil and Tylose. In an experiment, a fill time or a time for transport of the body fluid within the channel 148 was determined to 1.1 seconds, and the wait time was determined to 0.85 seconds. In FIG. 4B, a top view of the test element 110 is shown. Therein, the test chemical 138 is illustrated. The test chemical 138 and the cover element 146 cover the elongate receptacle 122. A transport of a body fluid 182 within the channel 148 was monitored.

Figure 5A:
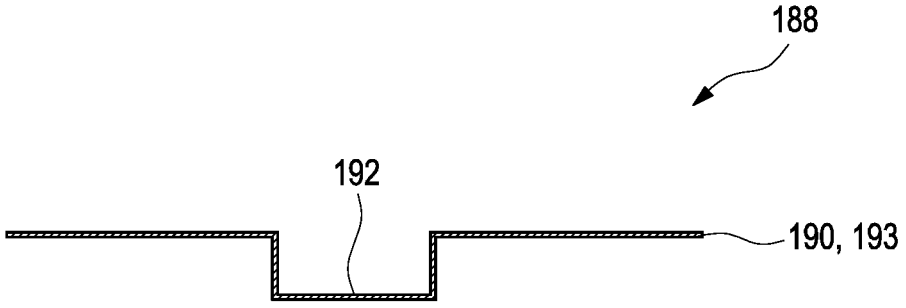
FIGS. 5A to 5C show a further exemplary method for manufacturing a test element, wherein different intermediate products and the test element are shown.
Figure 5B:
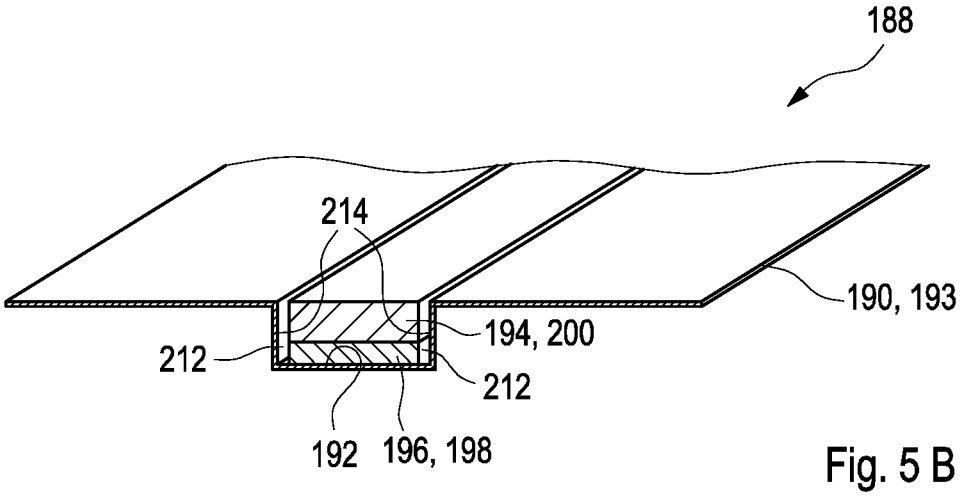
Figure 5C:
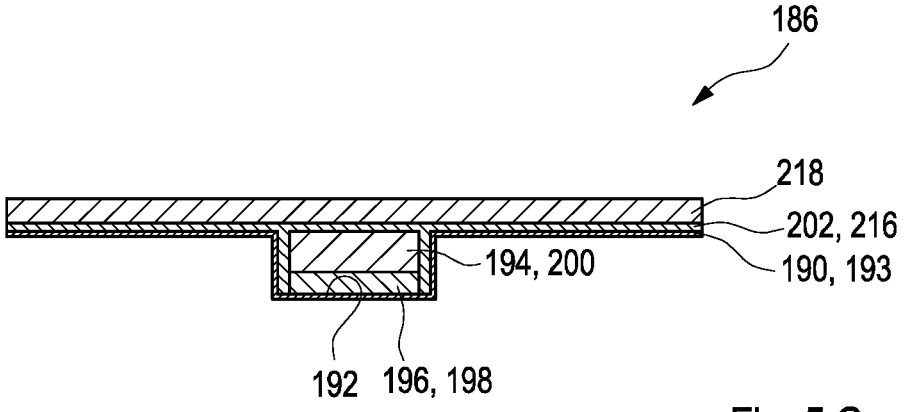

In FIGS. 5A to 5C, a further method for manufacturing a test element for detecting at least one analyte in a body fluid is illustrated. In FIG. 5C, the test element is shown in a perspective view. In FIGS. 5A and 5B, different intermediate products 188 are shown.

In a first step, as shown in FIG. 5A, at least one substrate 190 is provided. The substrate 190 may have at least one elongate receptacle 192. Exemplarily, the elongate receptacle 192 may be stamped into the substrate 190. The substrate 190 may specifically be an embossed foil 193. In a further step, as illustrated in FIG. 5B, at least one test chemical 194 may be placed within the elongate receptacle 192. Before the test chemical 194 is placed into the elongate receptacle 192, at least one foil 196 may be placed into the receptacle. The foil 196 may form a bottom 198 of the elongate receptacle 192. Specifically, the test chemical 194 may be provided as fine cut 200. Further, the test chemical 194 may be either placed into the elongate receptacle 192 or adhered to the elongate receptacle 192, specifically to the foil 196 via at least one adhesive material (not shown).

In a further step, as illustrated in FIG. 5C, at least one hydrophilic element 202 may be placed on the substrate 190. Specifically, the hydrophilic element 202 may be placed on the substrate 190 such that at least one gap 212, as illustrated in FIG. 5B, between the test chemical 194 and at least one surface 114 of the elongate receptacle 192 is filled with the hydrophilic element 202. Exemplarily, the hydrophilic element 102 may be provided as a foil 216. However, other embodiments may be feasible. Further, the hydrophilic element 202 may be coated with at least one hydrophilic layer 218 at least partially. Specifically, the coating of the hydrophilic element 202 may be conducted such that gaps (not shown) within the hydrophilic element 202 may be reduced at least to a large extent.

Figure 6A:
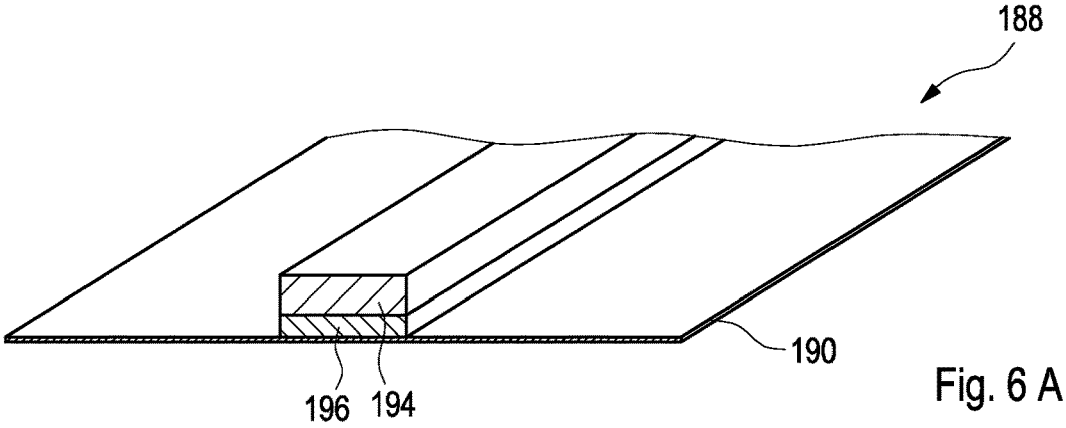
FIGS. 6A to 6D show a further exemplary method for manufacturing a test element, wherein different intermediate products and the test element are shown.
Figure 6B:
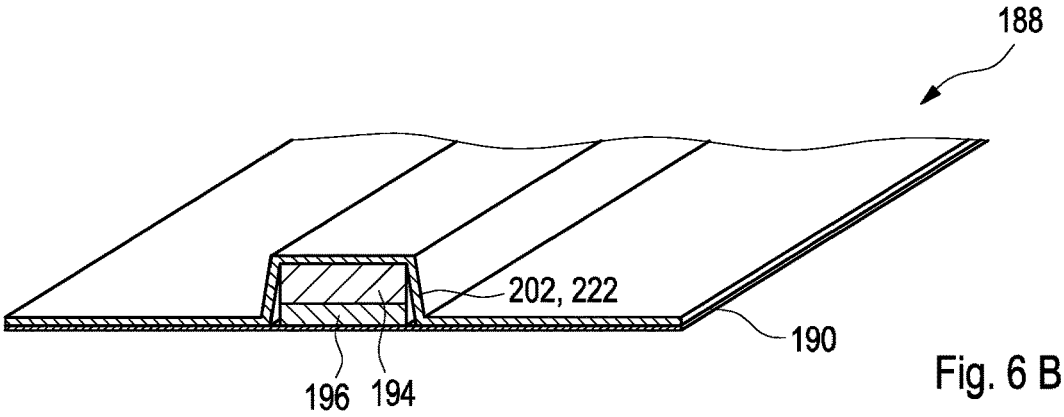
Figure 6C:
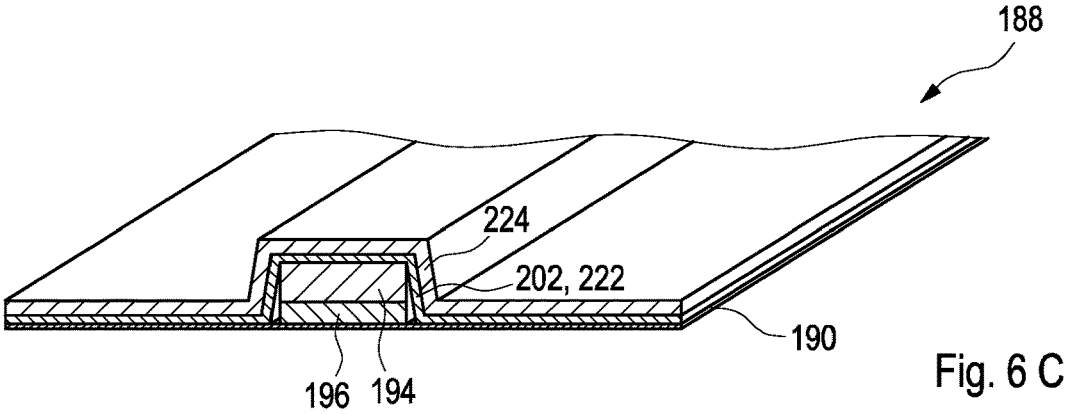
Figure 6D:
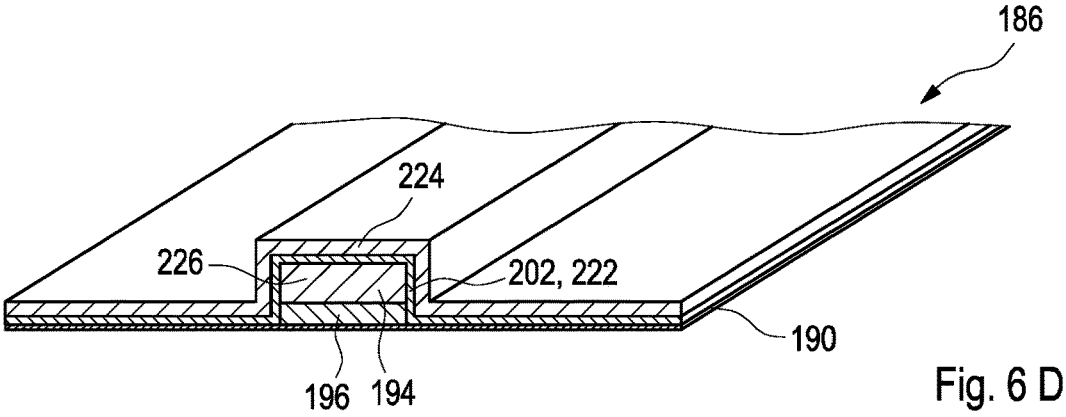

In FIGS. 6A to 6C, a further exemplary embodiment of a method for manufacturing a test element is illustrated. The test element 186 is illustrated in FIG. 6C in a cross-sectional view, and in FIGS. 6A and 6B different intermediate products 188 are shown. In a first step, as illustrated in FIG. 6A, the substrate 190 is provided. Further, the foil 196 and the test chemical 194 may be placed onto the substrate 190. In a further step, as illustrated in FIG. 6B, the hydrophilic element 202 which may specifically be provided as foil 222 may be placed onto the substrate, thereby covering the test chemical 194 and the foil 196. In a further step, a hydrophilic grid 224 may be placed onto the hydrophilic element 202. In a further step, as illustrated in FIG. 6C, a channel 226 may be formed, specifically via laser welding or gluing.

Figure 7A:
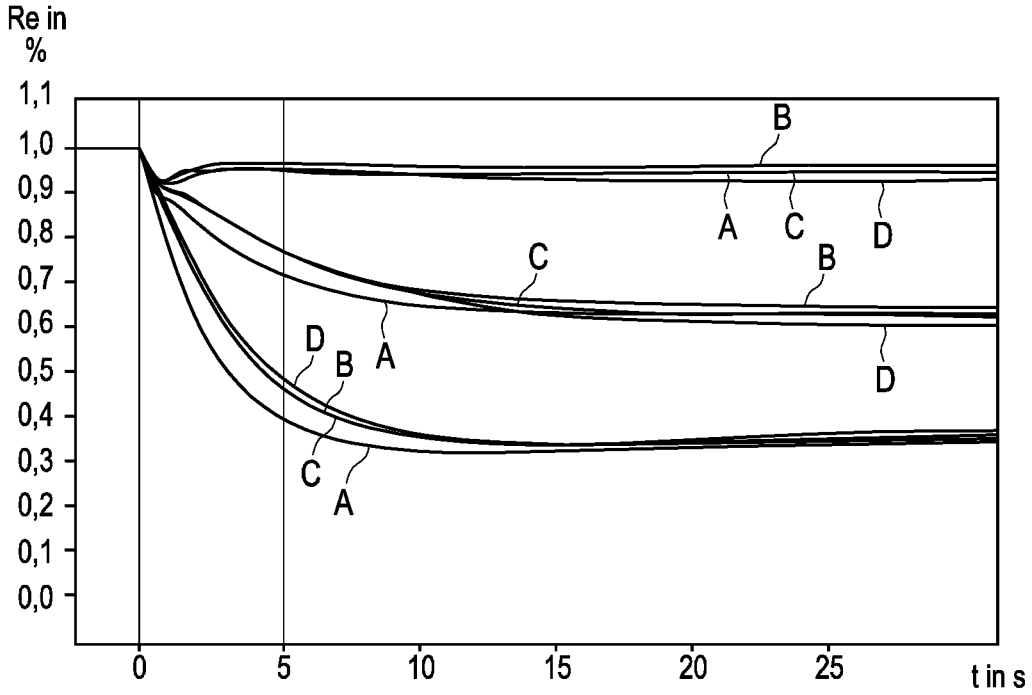
FIGS. 7A and 7B show a remission in dependence of time (FIG. 7A) and a difference of remission (FIG. 7B) for different thicknesses of the hydrophilic layer.
Figure 7B:
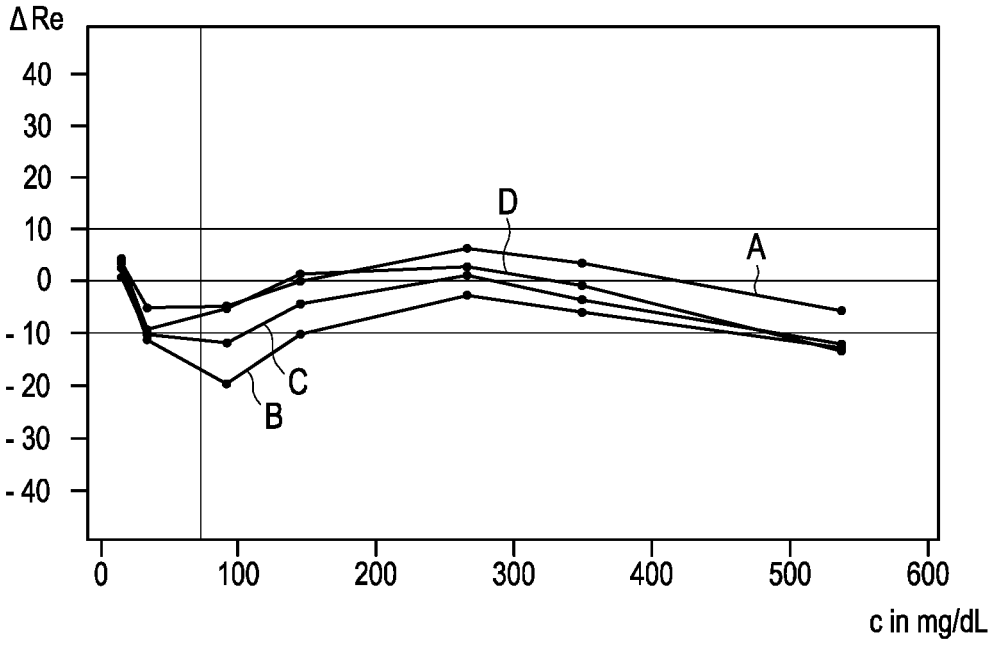

FIG. 7A shows a relative remission Re in dependence of time t and FIG. 7B shows the corresponding difference of remission ΔRe for different thicknesses of the hydrophilic layer which was applied via blanket coating in this particular embodiment. The data were acquired via a measuring device comprising an UV-LED and a detector and enzymatic reactions were monitored. Curves A correspond to a sample wherein no hydrophilic material was applied. Curves B correspond to a sample, wherein 0.03 $g/m^2$ of Tylose and 0.72 $g/m^2$ of Bindzil CC301 were applied leading to a hydrophilic layer with a thickness of 30 μm. Curves C correspond to a sample, wherein 0.05 $g/m^2$ of Tylose and 1.44 $g/m^2$ of Bindzil CC301 were applied leading to a hydrophilic layer with a thickness of 60 μm. Curves D correspond to a sample, wherein 0.10 $g/m^2$ of Tylose and 2.88 $g/m^2$ of Bindzil CC301 were applied leading to a hydrophilic layer with a thickness of 120 μm. It can be demonstrated that deviations in the kinetics are small. Consequently, applying a hydrophilic layer on the test chemical does not have a significant influence on a performance, i.e. there is no significant influence on kinetics.

LIST OF REFERENCE NUMBERS

110 test element
112 intermediate product
114 substrate
116 flat substrate
117 flat surface
118 substrate surface
120 direction of extension
122 elongate receptacle
124 foil
126 adhesive foil
128 adhesive surface
130 double-sided adhesive foil
132 further adhesive surface
134 opening
136 hydrophilic material
138 test chemical
139 partition
140 test chemical element
142 test chemical substrate
144 rigid element
146 cover element
148 channel
150 rigid element
152 capillary channel
154 channel surface
156 cover element surface
158 receptacle surface
159 continuous surface section
160 surface section
161 opening
162 hydrophilic layer
164 continuous hydrophilic layer
166 single element
168 support element
170 flat substrate
172 flat surface
174 surface
176 test chemical surface
178 unit
180 roll good
182 body fluid
186 test element
188 intermediate product
190 substrate
192 elongate receptacle
193 embossed foil
194 test chemical
196 foil
198 bottom
200 fine cut
202 hydrophilic element
212 gap
214 surface
216 foil
218 hydrophilic layer
220 gap
222 foil
224 grid
226 channel
228 adhesive surface
230 foil

The invention claimed is:

1. A method for manufacturing a test element for detecting at least one analyte in a body fluid, wherein the method comprises the following steps:

providing at least one substrate having at least one elongate receptacle on a substrate surface of the substrate;

placing at least one test chemical on the substrate in a manner that the test chemical covers a partition of the elongate receptacle, the test chemical having a test chemical edge;

placing a cover element on the substrate coplanar with and laterally displaced from the test chemical, the cover element having a cover edge laterally displaced from the test chemical edge, a lateral gap being formed between the cover edge and the test chemical edge, the cover element covering the elongate receptacle at least partially, whereby a channel having a channel surface is formed;

applying at least one hydrophilic material to at least one surface section of the channel surface, wherein the surface section is adjacent to the test chemical; and applying a hydrophilic layer, filling in the area of the gap between the test chemical edge and the cover edge, the hydrophilic layer bridging the gap between the test chemical edge and the cover edge and in such a manner that at least one surface section of the channel surface is covered with the hydrophilic layer.

2. The method according to claim 1, wherein the surface section is a continuous surface section extending from an opening of the channel to the test chemical.

3. The method according to claim 1, wherein the at least one channel surface is formed by at least one surface selected from the group consisting of: the substrate surface, a cover element surface of the cover element, and a receptacle surface of the elongate receptacle.

4. The method according to claim 3, wherein the surface section covered by the hydrophilic material is part of the cover element surface, wherein the hydrophilic material is applied such that the hydrophilic material forms a connection between the surface section and the test chemical.

5. The method according to claim 3, wherein the surface section covered by the hydrophilic material is part of the receptacle surface, wherein the hydrophilic material is applied such that the hydrophilic material forms a connection between the surface section and the test chemical.

6. The method according to claim 1, wherein the hydrophilic material is applied such that further at least one test chemical surface section of at least one test chemical surface of the test chemical is covered with the hydrophilic material.

7. The method according to claim 1, wherein the hydrophilic material is applied on the substrate before the test chemical and the cover element are placed on the substrate, wherein the hydrophilic material is applied such that at least a partition of the elongate receptacle is covered with the hydrophilic material.

8. The method according to claim 1, wherein the test chemical and the cover element form one single element such that the test chemical and the cover element are placed on the substrate as one unit, wherein the hydrophilic material is applied to at least one surface of the single element.

9. The method according to claim 1, wherein the hydrophilic material comprises at least one material selected from the group consisting of: a polymer, a surface-active substance, a filling material, and a reactive component.

10. The method according to claim 9, wherein the polymer is selected from the group consisting of: cellulose, polyethylene glycol, polyvinyl alcohol, polyolefin, polyurethane, polyamide, polyimide, polyacrylate, polycarbonate, polyester, polyether, polyvinyl ether, polyvinyl ester, polyvinyl alcohol, and polysiloxane.

11. The method according to claim 9, wherein the hydrophilic material is an anionic surfactant.

12. A test element for detecting at least one analyte in a body fluid, wherein the test element comprises:

at least one substrate having at least one elongate receptacle;

at least one test chemical on the substrate and having a test chemical edge, wherein the test chemical covers the elongate receptacle at least partially, a cover element on the substrate, the cover element being coplanar with and laterally displaced from the test chemical, the cover element having a cover edge laterally displaced from the test chemical edge, a lateral gap being formed between the cover edge and the test chemical edge;

at least one channel having a channel surface being formed by the cover element covering the elongate receptacle at least partially;

at least one hydrophilic material, which is a suspension or solution, configured to cover at least one surface section of the channel surface, wherein the surface section is adjacent to the test chemical; and a hydrophilic layer filling in the area of the gap between the test chemical edge and the cover edge and bridging the gap between the test chemical edge and the cover edge in such a manner that at least one surface section of the channel surface is covered with the hydrophilic layer.

13. A method for detecting at least one analyte in a body fluid, the method comprising the following steps:

providing a test element according to claim 12;

placing a sample of the body fluid into at least one opening of the channel;

transporting the sample of the body fluid to the test chemical; and conducting at least one electrical measurement or at least one optical measurement thereby detecting at least one detection reaction between the test chemical and the sample of the body fluid.

14. A system for detecting at least one analyte in a body fluid, the system comprising at least one test element according to claim 12, the system further comprising at least one measurement device adapted for performing at least one electrical measurement or at least one optical measurement using the test element.

15. The method according to claim 1, wherein the hydrophilic layer is a hydrophilic porous layer.

16. The test element according to claim 12, wherein the hydrophilic layer is a hydrophilic porous layer.

17. A method for manufacturing a test element for detecting at least one analyte in a body fluid, wherein the method comprises the following steps:

providing at least one substrate having at least one elongate receptacle on a substrate surface of the substrate;

placing at least one test chemical on the substrate in a manner that the test chemical covers a partition of the elongate receptacle, the test chemical comprising a top surface, a bottom surface, and an intervening test chemical edge;

placing a cover element on the substrate, the cover element comprising a top surface, a bottom surface, and an intervening cover edge, the cover edge being laterally displaced from the test chemical edge, a lateral gap being formed between the cover edge and the test chemical edge, the cover element covering the elongate receptacle at least partially, whereby a channel having a channel surface is formed;

applying at least one hydrophilic material to at least one surface section of the channel surface, wherein the surface section is adjacent to the test chemical; and applying a hydrophilic layer, filling in the area of the gap between the test chemical edge and the cover edge, the hydrophilic layer bridging the gap between the test chemical edge and the cover edge and in such a manner that at least one surface section of the channel surface is covered with the hydrophilic layer.

18. A method for manufacturing a test element for detecting at least one analyte in a body fluid, wherein the method comprises the following steps:

providing at least one substrate having at least one elongate receptacle on a substrate surface of the substrate;

placing at least one test chemical on the substrate in a manner that the test chemical covers a partition of the elongate receptacle, the test chemical having a test chemical edge;

placing a cover element on the substrate adjacent to but laterally displaced from the test chemical such that each of the cover element and the test chemical is positioned adjacent the substrate, the cover element having a cover edge laterally displaced from the test chemical edge, a lateral gap being formed between the cover edge and the test chemical edge, the cover element covering the elongate receptacle at least partially, whereby a channel having a channel surface is formed;

applying at least one hydrophilic material to at least one surface section of the channel surface, wherein the surface section is adjacent to the test chemical; and applying a hydrophilic layer filling in the area of the gap between the test chemical edge and the cover edge, the hydrophilic layer bridging the gap between the test chemical edge and the cover edge and in such a manner that at least one surface section of the channel surface is covered with the hydrophilic layer.

* * * * *